US010137358B2

(12) United States Patent
Yee

(10) Patent No.: US 10,137,358 B2
(45) Date of Patent: Nov. 27, 2018

(54) METHODS OF ADMINISTERING A WAGERING GAME INCLUDING A DEALER PAYOUT

(71) Applicant: Bally Gaming, Inc., Las Vegas, NV (US)

(72) Inventor: Ryan Masao Yee, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 354 days.

(21) Appl. No.: 14/827,717

(22) Filed: Aug. 17, 2015

(65) Prior Publication Data

US 2016/0089594 A1 Mar. 31, 2016

Related U.S. Application Data

(63) Continuation-in-part of application No. 14/496,977, filed on Sep. 25, 2014.

(51) Int. Cl.

| | |
|---|---|
| ***A63F 9/24*** | (2006.01) |
| ***A63F 1/00*** | (2006.01) |
| ***A63F 3/00*** | (2006.01) |
| ***G07F 17/32*** | (2006.01) |

(52) U.S. Cl.

CPC ..... *A63F 1/00* (2013.01); *A63F 3/00157* (2013.01); *G07F 17/3244* (2013.01); *G07F 17/3267* (2013.01); *G07F 17/3272* (2013.01); *A63F 2001/005* (2013.01); *G07F 17/3297* (2013.01)

(58) Field of Classification Search

USPC ..... 463/16–25

See application file for complete search history.

(56) References Cited

U.S. PATENT DOCUMENTS

| | | | |
|---|---|---|---|
| 4,836,553 | A | 6/1989 | Suttle et al. |
| 5,653,444 | A | 8/1997 | Dahl et al. |
| 5,685,774 | A | 11/1997 | Webb |
| 5,823,536 | A | 10/1998 | Flasch et al. |
| 5,863,041 | A | 1/1999 | Boylan et al. |
| 6,267,248 | B1 | 7/2001 | Johnson et al. |
| 6,588,750 | B1 | 7/2003 | Grauzer et al. |

(Continued)

OTHER PUBLICATIONS

Wizard of Vegas, Forums, "Pai Gow Insurance Dealer's Envy Bonus," <<http://wizardofvegas.com/forum/questions-and-answers/gambling/17864-pai-gow-insurance-dealers-envy-bonus/>> Apr. 17, 2014, 3 pages.

*Primary Examiner* — Masud Ahmed
(74) *Attorney, Agent, or Firm* — TraskBritt

(57) ABSTRACT

Methods of administering wagering games include accepting an ante wager from at least one player to participate in a poker game according to a set of poker game rules and accepting a bonus wager from the at least one player to participate in a bonus game according to a set of bonus game rules. A set of player cards are dealt to the player and to a dealer. The ante wager and the bonus wager are resolved according to the set of poker game rules and the set of bonus game rules, respectively. A dealer payout is paid to at least one of a dealer and a dealer pool when the at least one player receives a winning outcome in the bonus game. The dealer does not make a wager to receive the dealer payout. Games of the present disclosure may be implemented as live card games, multi-player EGM games, on-line games, and live card games with electronic betting interfaces.

20 Claims, 14 Drawing Sheets

(56) References Cited

U.S. PATENT DOCUMENTS

| | | | |
|---|---|---|---|
| 6,659,460 | B2 | 12/2003 | Blaha et al. |
| 6,698,756 | B1 | 3/2004 | Baker et al. |
| 6,719,291 | B1 | 4/2004 | deKeller |
| 6,755,741 | B1 | 6/2004 | Rafaeli |
| 6,896,514 | B2 | 5/2005 | DeVincenzo |
| 7,140,614 | B2 | 11/2006 | Snow |
| 7,334,794 | B2 | 2/2008 | Snow |
| 7,407,163 | B2 | 8/2008 | Snow |
| 7,661,676 | B2 | 2/2010 | Smith et al. |
| 7,677,565 | B2 | 3/2010 | Grauzer et al. |
| 7,766,332 | B2 | 8/2010 | Grauzer et al. |
| 7,901,285 | B2 | 3/2011 | Tran et al. |
| 7,905,770 | B2 | 3/2011 | Snow |
| 7,934,980 | B2 | 5/2011 | Blaha et al. |
| RE42,944 | E | 11/2011 | Blaha et al. |
| 8,070,574 | B2 | 12/2011 | Grauzer et al. |
| 8,262,475 | B2 | 9/2012 | Snow et al. |
| 8,272,958 | B2 | 9/2012 | Smith et al. |
| 8,371,918 | B2 | 2/2013 | Snow |
| 8,439,362 | B1 | 5/2013 | deKeller |
| 8,511,684 | B2 | 8/2013 | Grauzer et al. |
| 8,579,289 | B2 | 11/2013 | Rynda et al. |
| 2004/0075215 | A1 | 4/2004 | Snow et al. |
| 2005/0029741 | A1 | 2/2005 | Snow et al. |
| 2005/0082760 | A1 | 4/2005 | Yoseloff et al. |
| 2005/0164759 | A1 | 7/2005 | Smith et al. |
| 2006/0084505 | A1 | 4/2006 | Yoseloff et al. |
| 2006/0087082 | A1 | 4/2006 | Ko |
| 2007/0102882 | A1 | 5/2007 | Snow |
| 2007/0298854 | A1 | 12/2007 | Yoseloff et al. |
| 2008/0108412 | A1 | 5/2008 | Snow et al. |
| 2008/0150233 | A1 | 6/2008 | Coonan et al. |
| 2008/0303207 | A1 | 12/2008 | Snow |
| 2009/0079134 | A1 | 3/2009 | Snow et al. |
| 2009/0243217 | A1 | 10/2009 | Ko |
| 2010/0038849 | A1 | 2/2010 | Scheper et al. |
| 2010/0285869 | A1* | 11/2010 | Walker ..... G07F 17/32 463/25 |
| 2013/0184059 | A1* | 7/2013 | Costello ..... G07F 17/3223 463/22 |
| 2013/0184079 | A1* | 7/2013 | Costello ..... A63F 9/24 463/42 |
| 2013/0296025 | A1* | 11/2013 | Castle, II ..... G07F 17/32 463/25 |
| 2013/0324217 | A1 | 12/2013 | Gilbertson et al. |
| 2014/0027979 | A1 | 1/2014 | Stasson et al. |
| 2014/0087801 | A1* | 3/2014 | Nicely ..... G07F 17/3293 463/12 |
| 2014/0370980 | A1 | 12/2014 | Czyzewski et al. |

* cited by examiner

| HAND | PAYS | ENVY* |
|---|---|---|
| Royal Flush | 500 to 1 | $100 |
| Straight Flush | 200 to 1 | $25 |
| Four-of-a-Kind | 50 to 1 | $10 |
| Full House | 25 to 1 | $5 |
| Flush | 12 to 1 | $3 |
| Straight | 8 to 1 | $1 |
| Three-of-a-Kind | 5 to 1 | |

*ENVY PAYOUTS ARE PAID TO THE DEALER

Shuffle MASTER

METHODS OF ADMINISTERING A WAGERING GAME INCLUDING A DEALER PAYOUT

CROSS-REFERENCE TO RELATED APPLICATION

This application is a continuation-in-part of U.S. patent application Ser. No. 14/496,977, filed Sep. 25, 2014, pending, the disclosure of which is hereby incorporated herein in its entirety by this reference.

FIELD

The disclosure relates generally to methods of administering wagering games for casinos and other gaming establishments, and related systems and apparatuses. More specifically, disclosed embodiments relate to methods of administering wagering games involving a payout to one of a dealer and a dealer pool each time a participating player wins a bonus wager.

BACKGROUND

Many wagering games, such as blackjack, baccarat, poker, pai gow poker, etc., include one or more bonus wagers and/or side wagers. Because the bonus wagers and side wagers frequently increase the profits to gaming establishments or casinos operating the wagering game, gaming establishments desire that participating players place the bonus wagers and side wagers.

Participating players may be discouraged from playing wagering games against a dealer when they perceive that the dealer (or the house) has an advantage. Such players may be more inclined to play wagering games where each participating player plays only against other participating players and the dealer does not participate in the underlying game. However, in many wagering games, such as in blackjack, baccarat, various forms of poker, pai gow poker, etc., participating players may play against the dealer.

BRIEF SUMMARY

In some embodiments, the present disclosure includes a method of administering a wagering game. The method includes accepting an ante wager from a player to participate in a poker game by receiving at least one tangible, monetarily valuable gaming chip in a designated ante wager area on a play surface of a play table, accepting an optional bonus wager from the player to participate in a bonus game by receiving at least another tangible, monetarily valuable gaming chip in a designated bonus wager area on the play surface of the play table, delivering a set of player cards to the player in a player card receiving area on the play surface of the play table from a deck of physical cards comprising a set of at least one 52-card deck of standard playing cards utilizing a card-handling device configured to present randomized cards for delivery, delivering a set of dealer cards to the dealer at a dealer card receiving area on the play surface of the play table from the card-handling device, if the ante wager was accepted from the player, accepting at least one of a play wager from the player or receiving a fold indication from the player, paying the player a payout on the bonus wager when the player obtains a winning outcome according to rules of the bonus game, paying a dealer payout to at least one of a dealer and a dealer pool when the player obtains a winning outcome according to the rules of the bonus game, wherein the dealer does not make a wager to receive the dealer payout, and paying the player a payout on the ante wager when the player obtains a winning outcome according to rules of the poker game and taking each gaming chip associated with the ante wager when the player does not obtain a winning outcome according to the rules of the poker game.

In some embodiments, accepting an ante wager by receiving at least one tangible, monetarily valuable gaming chip in a designated ante wager area on a play surface of a play table from the player includes accepting an ante wager from the player to participate in a game of three-card poker against a dealer three-card poker hand.

One or more additional side wagers may be offered with the game. For example, a side wager may be offered that pays when the player hand has a predetermined poker rank. The side wager may pay odds payouts for various predetermined winning poker hands.

In additional embodiments, the present disclosure includes a method of administering a wagering game. The method includes accepting an ante wager from a participating player to participate in a poker game according to a set of poker game rules by receiving at least one tangible, monetarily valuable gaming chip in a designated ante wager area on a play surface of a gaming table layout. The method includes accepting a mandatory bonus wager from the participating player to participate in a bonus game according to a set of bonus game rules by receiving at least another tangible, monetarily valuable gaming chip in a designated bonus wager area on the play surface of the gaming table layout, dealing a set of player cards to the participating player in a player card receiving area on the play surface of the gaming table layout from a deck of physical cards comprising at least one 52-card deck of standard playing cards utilizing a card-handling device configured to present randomized cards for delivery, dealing a set of dealer cards to a dealer at a dealer card receiving area on the play surface of the gaming table from the card-handling device, resolving the ante wager according to the set of poker game rules, resolving the bonus wager according to the set of bonus game rules, and paying a dealer payout to at least one of the dealer and a dealer pool when the participating player achieves a winning outcome on the bonus wager according to the set of bonus game rules.

In yet additional embodiments, the present disclosure includes a method of administering a wagering game over a network utilizing a processor. The method includes receiving, at a server comprising at least one processor, an electronic signal indicating that an ante wager to participate in a poker game was accepted from a player, receiving, at the server, an electronic signal indicating that a bonus wager to participate in a bonus game was accepted from the player, randomly assigning, utilizing the server, a player hand to the player, the player hand comprising three playing cards from a deck of playing cards comprising at least a 52-card set of standard playing cards, randomly assigning, utilizing the server, three playing cards from the deck of playing cards to a dealer hand, resolving, with the server, the ante wager according to rules of the poker game, resolving, with the server, the bonus wager according to rules of the bonus game, and sending an electronic signal, with the server, indicating that payment of a dealer payout to a dealer pool is authorized when the player receives a winning outcome in the bonus wager. In online versions of the game utilizing human dealers who deal card games in a studio, the dealers enjoy dealer envy payouts not received in other known games.

Embodiments that implement a side wager or the bonus wager may also be practiced over a network.

Yet other embodiments may comprise apparatuses and systems for administering wagering games according to embodiments of the disclosure.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
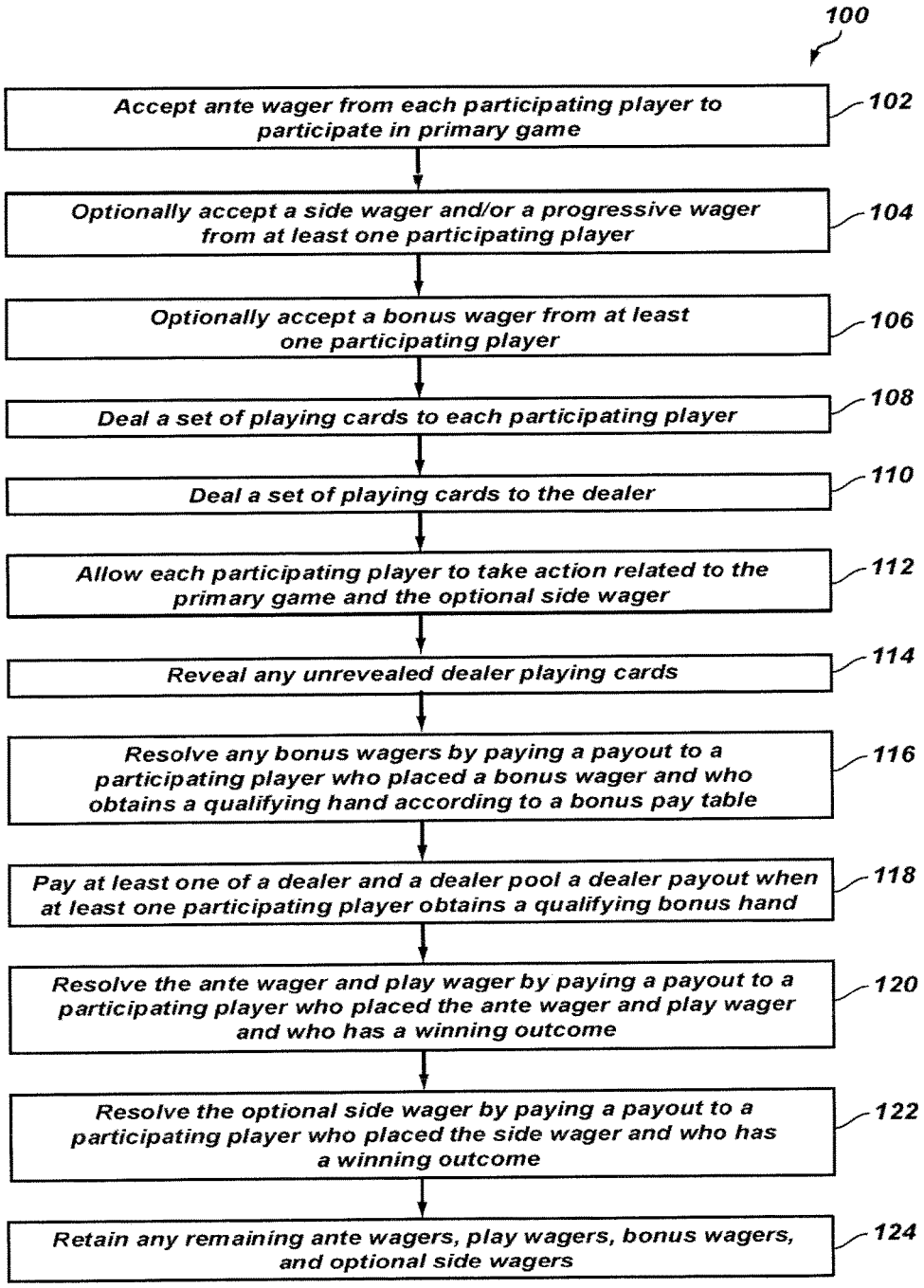
FIG. 1 is a flowchart diagram of a method of administering a wagering game, according to an embodiment of this disclosure.

The illustrations presented in this disclosure are not meant to be actual views of any particular act in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "gaming," "gambling," or the like, refer to activities, games, sessions, rounds, hands, rolls, operations, and other events related to wagering games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked," "player-banked," "player-pooled" including "player-pooled progressive," and "dividend refund" configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, wagering from a credit meter, other physical means for payment, and online or remote electronic authorization of a wager in any acceptable form to the casino or online or virtual game host. Also included are physical representations of money (e.g., casino chips) at a local gaming establishment, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, making payouts, dealing cards, selecting cards, or other actions associated with a player or a dealer is described herein, and such description includes a player or a dealer taking the action, the results of the action may be computer generated and may be displayed on a live or virtual table or electronic display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, on a gaming terminal, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player.

Gaming establishments, such as casinos, frequently desire that players participating in wagering games place all wagers (e.g., ante wagers, play wagers, raise wagers, bonus wagers, side wagers) associated with a game to maximize revenue. The gaming establishment may, however, not provide motivation for the dealer to encourage participating players to place one or more optional bonus wagers and side wagers. For example, dealers dealing such games may not have an incentive to encourage participating players to place bonus wagers because they may not receive increased compensation (e.g., wages, tips, etc.) when participating players place a bonus wager. Players are often discouraged from placing bonus wagers when they perceive that they are playing against a more experienced dealer or when the house has an advantage. However, according to embodiments herein, each time a player obtains a winning outcome in a bonus wager, a dealer or a dealer pool may automatically receive a dealer payout. Thus, according to some embodiments, the dealer may receive a payout when a player obtains a winning outcome in a bonus wager. The dealer may receive the dealer payout without a dealer contribution. In other words, the dealer may receive the payout without a dealer contribution, placing a wager, or participating in the bonus wager game, other than administering the game. The dealer payout may motivate the dealer to encourage players to place the bonus wager. Players may be motivated to place the bonus wager knowing that the dealer wins each time the player wins. For example, the dealer may receive the dealer payout all or part of the time, a participating player wins the bonus wager, giving the participating players a sense of camaraderie with the dealer. In other words, players may be more willing to place a bonus wager knowing that when the player wins some bonus wagers, the dealer also wins (i.e., receives a payout).

Referring to FIG. 1, a flowchart diagram of a method of administering a wagering game is shown. Generally, the method 100 includes administering a wagering game in which one or more winners may be determined according to the rules of an underlying primary game such as traditional blackjack, blackjack variants (e.g., BLACKJACK SWITCH®, BLACKJACK PRESS$^{SM}$, POWER BLACKJACK$^{SM}$, FREE BET BLACKJACK$^{SM}$, BURN 20$^{SM}$ BLACKJACK, NEVER BUST BLACKJACK$^{SM}$, etc.), poker variants (e.g., two-card poker, THREE CARD POKER®, FOUR CARD POKER$^{SM}$, ULTIMATE TEXAS HOLD 'EM$^{SM}$, Texas hold 'em, five-card stud, six-card stud, seven-card stud, etc.), baccarat, pai gow poker, etc., including an optional bonus wager, and a dealer payout when the player wins a bonus payout. The placement and outcome of the bonus wager may be independent of the outcome of the underlying primary game. For example, play of the bonus wager may not affect the primary game or a player strategy in the underling primary game. The bonus wager may be any wager based on initial cards dealt to each participating player, a dealer hand, a set of community cards or combinations thereof. In one embodiment, the underlying game is blackjack, played according to the rules of traditional blackjack, which are not described in detail herein. In some embodiments, the optional bonus wager is a KING'S BOUNTY™ bonus wager in which players make a standard blackjack wager and the KING'S BOUNTY™ bonus wager. The dealer deals blackjack according to house procedures. Players win the KING'S BOUNTY™ bonus wager if the point value of the first two cards dealt to a player have a numerical point total of exactly twenty (20). In another embodiment, the underlying game is poker, such as THREE CARD POKER® (e.g., as described in U.S. Pat. No. 5,685,774) in which three cards are dealt to each player and three cards are dealt to the dealer. Initially, a player may place at least one of an ante wager and an optional side wager to participate in the game. The dealer permits the player to view his three cards. The dealer must receive a play wager from the player or a fold election. The ante and play wager resolution may be based on a comparison of a poker rank of the player's cards against a poker rank of the dealer's cards. In some embodiments, the player is dealt three cards and the dealer is dealt three cards and the ante and play wager resolution is based on a comparison of the poker rank of the three-card hand of the player to the three-card hand of the dealer. The optional side wager may be based on a comparison of the three-card hand of the player against a predetermined paytable. One such wager is the "Pair Plus" wager, a wager that the player will achieve a three-card hand that will have a rank of at least one pair or higher, according to a predetermined paytable. The optional bonus wager may be based on a poker rank of a five-card hand formed from three cards dealt to the player and three cards dealt to the dealer. For example, a five-card poker hand may be formed from six cards comprising three cards dealt to the player and three cards dealt to the dealer. A player may win the bonus wager by obtaining a five-card poker hand having a predetermined rank. One such bonus wager may be referred to as a "6 Card Bonus" wager wherein players wager that a five-card poker hand formed from a six-card hand derived from the combination of a three-card player hand and a three-card dealer hand will have a predetermined poker rank.

At the beginning of game play, the dealer may accept at least one of an ante wager and an optional side wager, such as the Pair Plus bonus wager from at least one participating player to participate in the primary game (e.g., poker). The dealer may optionally accept a bonus wager from the at least one participating player to participate in a secondary game (e.g., the bonus wager, such as the "6 Card Bonus" wager). The dealer may deal at least three cards from a physical set of playing cards to the at least one participating player and the dealer may deal at least three cards to the dealer. The dealer cards and the player cards may be revealed and the ante wager, the optional side wager, and the bonus wager may be resolved. At least one of the dealer and a dealer pool may be paid a payout when at least one player who placed the bonus wager obtains one of a plurality of winning outcomes according to rules of the bonus game. The dealer may not be required to place a wager to receive the dealer payout; and the dealer may not receive a payout for all winning player hands.

The dealer may automatically qualify to receive the dealer payout each time a participating player places the bonus wager. In some embodiments, the dealer payout is made each time a player who placed the bonus wager receives a winning outcome in the bonus wager. In other embodiments, the dealer receives a payout when the player receives certain predetermined bonus payouts.

The total amount of, and potentially the multiplier for, the dealer payout may be increased as the number of players at a play table increases, further motivating the dealer to encourage more players to play at the dealer's table. For example, the dealer may receive more than one dealer payout per round of game play, such as when more than one participating player makes the bonus wager and receives a winning outcome on the bonus wager.

The dealer payout is paid either directly to the dealer or to a dealer pool. Funds from the dealer pool may be divided among dealers dealing a particular game or dealing within a particular section of a casino or gaming establishment. Thus, the dealer payout may be different from a house commission or a rake because the dealer payout is paid directly to the dealer or a dealer pool, rather than to the gaming establishment or casino and the dealer may retain the dealer payout as a tip and may not have an obligation to return any portion of the tip to the gaming establishment or casino.

In one embodiment, the primary game is blackjack, played according to house procedures. The optional bonus wager may be any blackjack bonus wager or side wager, such as the KING'S BOUNTY™ bonus wager described above. In another embodiment, the primary game is THREE CARD POKER® played according to house procedures. The optional bonus wager may be any bonus wager or side wager, such as the "6 Card Bonus" wager described above.

To begin play, at operation 102, the dealer accepts an ante wager from at least one player. The dealer of the house may receive an indication that an ante wager has been made or received from each particular location, such as at a location associated with a particular player. The ante wager qualifies each player to participate in the primary three-card poker game and is based on a comparison of a poker rank of the player's hand against a poker rank of the dealer's hand. The ante wager may be accepted from each player wishing to participate in an upcoming wagering game (which may represent the start of one game of play). A game session may comprise one or more individual game plays. When multiple players are participating in the same game, all player cards are typically dealt from the same deck, and the dealer accepts all player wagers before card distribution begins.

As a specific, nonlimiting example, the individual players may begin a gaming session at an electronic gaming table 400, or 500 (see FIGS. 6 and 7) (e.g., by logging into a player account, or by inserting currency into a currency acceptor, by inserting a ticket in a ticket in/ticket out reader, by swiping a player account card) and interact with personal interface devices 332, 416, 532, 620, 640, (see FIGS. 5 through 8, and 10) (e.g., touchscreens, keyboards, buttons, switches, etc.) to authorize placement of the ante wager. The ante wager may be provided, for example, by placing physical money or physical representations of money (e.g., chips) in a designated area of a gaming table 150, 400, 500 (see FIGS. 2, 6, and 7), by displacing digital representations of money in a designated area of at least one display screen 374, 416, 430, 532, 560, 564, or 658 (see FIGS. 5 through 7, and 10), or by displaying a monetary amount of the first wager on at least one display screen 374, 416, 430, 532, 560, 564, or 658 (see FIGS. 5 through 7, and 10), which may be remotely located from a dealer or game server 610 (see FIG. 8).

The ante wager may be accepted, for example, by electronically accepting funds from a player account or other credit authorized via one or more communications media (e.g., via the Internet, wireless communications, land line) on a remote electronic device (e.g., a personal computer, a laptop, a tablet computer, or a smartphone) by player input; electronically accepting funds from a player account authorized on a local wagering game administration device in a casino by player input; or physically placing money or representations of money (e.g., chips) on a table at a live game in a casino. Suitable network architecture for electronically accepting funds from a player account authorized on a remote device may comprise, for example, the network gaming architecture as disclosed in U.S. patent application Ser. No. 13/353,194, filed Jan. 18, 2012, published as U.S. Patent Application No. 2013/0184079 on Jul. 18, 2013, titled "NETWORK GAMING ARCHITECTURE, GAMING METHODS, AND RELATED METHODS," to Costello et al., and U.S. patent application Ser. No. 13/609,031, filed Sep. 10, 2012, published as U.S. Patent Application Publication No. 2013/0184059 on Jul. 18, 2013, titled "NETWORK GAMING ARCHITECTURE, GAMING SYSTEMS, AND RELATED METHODS," to Costello et al., the disclosure of each of which is incorporated herein in its entirety by this reference. Suitable local wagering game administration devices may comprise, for example, the chipless table disclosed in U.S. Pat. No. 8,262,475, issued Sep. 11, 2012 to Snow et al., the disclosure of which is incorporated herein in its entirety by this reference.

At operation 104, an optional side wager may be accepted from at least one participating player. The optional side wager may be accepted before any cards are dealt, or after cards are dealt but before the at least one participating player is allowed to inspect his or her playing cards. The side wager may be based on a comparison of the player's cards to predetermined poker ranks according to a paytable, such as the Pair Plus side wager. The side wager may also include any other number of side wagers, such as a player envy side wager wherein a player placing the side wager wins a payout when another participating player receives a particular winning outcome (e.g., a particular poker rank) in the underlying game. In some embodiments, and as will be described in further detail below, the side wager may be a progressive wager. Each participating player may place more than one side wager, the outcome of each of which may be determined according to rules of each side wager game. In some embodiments, the ante wager is optional (e.g., the player may not place the ante wager) and the player may receive a hand to participate in the optional side wager and the bonus wager without placing the ante wager. In other embodiments, the side wager may also include payouts to the dealer for predetermined poker hands.

One or more bonus wagers may be accepted from at least one participating player, as indicated at operation 106. To be eligible to place the bonus wager, each participating player may be required to place at least one of the ante wager and the optional side wager. However, in some embodiments, the bonus wager may be placed without placing either of the ante wager or the side wager. The bonus wager may be accepted from participating players before any cards are dealt, or at least before the at least one participating player is allowed to inspect his or her playing cards. As described above, the bonus wager may be any wager based on an underlying poker game, such as a three-card poker game. The bonus wager may be based, for example, on initial cards dealt to each participating player and to the dealer. For example, the bonus wager may be based at least on the initial three cards dealt to each participating player and to the dealer in a three-card poker game. The bonus wager may be based on a predetermined poker rank of a bonus hand. The bonus hand may be formed from at least some cards in the dealer's hand and at least some cards in the participating player's hand. In some embodiments, the bonus wager may be based on the initial three cards dealt to the dealer. The bonus wager may include, for example, a wager that the three cards of the at least one participating player and the three cards of the dealer will form a best five-card poker hand having a predetermined poker rank. In other words, a participating player may obtain a winning outcome on the bonus wager when the bonus hand formed from at least some of the cards in the participating player's hand and at least some of the cards in the dealer's hand has a predetermined poker rank. Participating players may receive varying payouts and/or payout odds for various five-card poker hands, including, for example, a royal flush, a straight flush, a four-of-a-kind, a full house, a flush, a straight, and a three-of-a-kind. The top award may occur when the resulting five-card hand is a royal flush. A straight flush may be the next highest rank, followed by a four-of-a-kind, a full house, a flush, a straight, and a three-of-a-kind. In some embodiments, a player may receive a payout if the five-card hand includes two pairs or a single pair. The highest ranking hand may be awarded the highest payout odds. In addition to poker, the bonus wager may be played in conjunction with any underlying game in which the dealer and each participating player are dealt an initial three-card hand, in games where the sum of the number of cards in each player's initial hand and the dealer's initial hand is five, six, seven, or more, in games where the number of player cards and community cards is five, six, seven or more (e.g., Let It Ride poker). In some embodiments, the bonus wager may be based on the five-card hand formed from five, six, seven, or more cards dealt to the dealer or to the player (e.g., Pai Gow Poker). Other games, such as Baccarat may provide between four and six cards in the player and banker hand to make a best 4-card poker hand. The side bet outcome can be based on any combination of player cards, dealer cards, community cards, extra draw cards, wild cards or special cards. Payouts can be based on poker ranking, blackjack ranking, baccarat ranking or other ranking system. For example, a game could employ a ranking system based on suit, with hearts outranking diamonds, diamonds outranking clubs, and clubs outranking spades. Multiples outrank singletons. In a side bet game where a player holds five diamonds, the player wins a highest payout. In some embodiments, each participating player may place more than one bonus wager, the outcome of each of which may be based on cards initially dealt to each participating player, on cards initially dealt to the dealer, on community cards, and combinations thereof.

After the ante wager, the optional bonus wager, the optional side wager and any other optional wagers have been accepted, a set of player cards may be dealt to each participating player, as indicated at operation 108. By way of example and not limitation, three player cards may be dealt to each participating player, although any predetermined number of cards may be dealt to each participating player as dictated by game or house rules (e.g., 1, 2, 4, 5, 6, 7, etc., cards). For example, physical cards that have been randomized (e.g., by manual or automated shuffling) may be distributed sequentially to each participating player, or in groups the order of which may be dictated by a set of game or house rules. In additional embodiments, digital representations of cards (e.g., images resembling physical cards or characters and symbols) may be displayed on personal display screens 374, 416, 532, or 658 (see FIGS. 5 through 7, and 10, respectively) for individual players. In some embodiments, the electronically generated cards may be displayed, for example, to remote players over a network.

The player cards may be dealt face down at a gaming table and in electronic implementations may only be visible to the individual player to whom the set of player cards was dealt. It is understood that "face down" may refer to physical playing cards that are in a face down orientation or digital indications or representations of cards that may show card backs and whose faces are not yet revealed to one or more participating players. In other embodiments, one, two, three, or more (depending on the underlying game) of the player cards may be made visible to both the player to whom they were dealt and other participating players, for example, by dealing some or all of the player card(s) face up. Further embodiments may involve dealing any predetermined or selected number of cards face up, up to and including all of the cards dealt to each individual player. In some embodiments where the ante wager is based on a three-card poker outcome, three initial cards may be dealt face up to each participating player.

Another set of cards against which each participating player's set of playing cards is to be played (e.g., dealer cards) may be dealt with one or more cards face down, such as in front of the dealer, as indicated at operation 110. In other embodiments, the primary game may be a game against a paytable or other player hands and, in those instances, no dealer cards are dealt. In some embodiments, one or more of the dealer cards may be dealt face up. For example, in three-card poker, one of the dealer cards may be dealt face up and the other dealer cards may be dealt face down. In some embodiments, all player and dealer cards may be dealt at the same time as packs of randomized cards. In other embodiments, cards may be delivered individually to each participating player card position and to the dealer card position until a predetermined number of cards is given to each participating player and to the dealer. In some embodiments, the dealer is dealt the same number of cards as each participating player (e.g., three cards).

After the set of player cards and the set of dealer cards are dealt to each player and the dealer, respectively, each participating player may take a player action in the primary game and any optional side wagers, as indicated at operation 112 (e.g., prior to revealing the dealer's cards or the dealer's face down cards). After inspecting his or her set of player cards, each participating player may be allowed to take a suitable action according to the rules of the primary game and the optional side wager. For example, where the primary game is three-card poker, the player may be allowed to place a play wager, according to house rules, as known in the game of three-card poker. In some embodiments, the player may either place a play wager to continue play in the three-card poker game, or may fold and forfeit the ante wager. A player may, for example, fold when the player's three-card hand has a low poker rank and may raise when the player believes the player's three-card hand will have a higher poker rank than the dealer's three-card hand. The play wager may be a multiple of the ante wager and may, in some embodiments, be an amount equal to the ante wager. In some embodiments, a player who placed the optional side wager, the bonus wager, or both, may still qualify to receive a corresponding payout even if the player folds and does not place a play wager.

After each participating player has taken action in the primary game (placed the play wager or folded), any unrevealed dealer cards may be revealed, as indicated at operation 114.

After each participating player and the dealer have been dealt their respective set of playing cards and each participating player has taken action, the bonus wager may be resolved (e.g., settled), as indicated at operation 116. The bonus wager may be resolved according to rules of a secondary, bonus game. The bonus wager may be based on a bonus hand formed from at least some of the cards in the participating player's hand and at least some of the cards in the dealer's hand. In some embodiments, the outcome of the bonus wager may be based on a five-card poker rank of a six-card poker hand formed from an initial three cards dealt to each participating player and three cards dealt to the dealer. The outcome of the bonus wager may be based on a paytable. A player may receive a winning outcome in the bonus wager independent of whether or not the player receives a winning outcome in the underlying primary game. For example, a player may have a three-card poker hand with a lower poker rank than the dealer's three-card poker hand, but the combination of the player's three cards and the dealer's three cards may form a winning five-card poker hand. By way of nonlimiting example, a player's three-card hand may include an unsuited 5, 6, 7, while a dealer's three-card hand may include an unsuited 8, 9, 10. In such a game, the player may lose the underlying ante wager and play wager, but may receive a winning outcome in the bonus game (e.g., a straight). In some embodiments, a player may elect to fold (i.e., not place the play wager) but may still qualify for, and obtain, a winning outcome in the bonus wager. In other embodiments, the player may not qualify for the bonus wager payout if the player does not place a play wager. A bonus payout may be paid to a qualifying participating player according to a bonus paytable. For example, a payout of the bonus wager may be based on the poker rank the bonus hand formed from five cards made up of the initial cards dealt to the participating player and to the dealer, according to the odds shown in Table I.

TABLE I

| Five-Card Hand | Payout |
|---|---|
| Royal Flush | 500 to 1 |
| Straight Flush | 200 to 1 |
| Four-of-a-kind | 50 to 1 |
| Full House | 25 to 1 |
| Flush | 12 to 1 |
| Straight | 8 to 1 |
| Three-of-a-kind | 5 to 1 |

Although Table I shows examples of predetermined odds for winning the bonus wager, it is recognized that the present disclosure is not limited to the payout odds listed in the table and may be changed. In some embodiments, the payouts may be fixed payouts rather than based on odds. In some embodiments, a five-card hand including a pair or two pairs may qualify for a payout. The payouts may be adjusted to provide a house advantage.

The bonus wager may be settled immediately after a set of playing cards have been dealt to each participating player and a set of playing cards have been dealt to the dealer. In other embodiments, where a play wager is required for a player to receive a payout on the ante wager, the bonus wager may be settled after receiving an indication from the player that the player wishes to either place the play wager or fold.

Although Table I shows illustrative bonus hands, which may qualify as winning outcomes of the bonus wager, the bonus wager is not so limited. For example, the bonus wager may include a hand including any number of cards, depending on the primary game. The bonus wager, however, may not affect game play of the underlying primary game. In some embodiments, the bonus wager is determined based only on the initial cards dealt to each participating player and may also include consideration of cards initially dealt to the dealer at the dealer position. As noted above, the bonus wager may also be determined at least partially by the cards dealt in a community card area in addition to player cards, dealer cards, or both.

If a participating player who placed a bonus wager does not have a predetermined qualifying bonus hand, the bonus wager of that player may be retained, such as by the casino or other gaming establishment.

Each time a participating player receives a payout in the bonus wager, at least one of the dealer and a dealer pot may be awarded a separate tip (e.g., a dealer payout), as indicated at operation 118. Moreover, a dealer payout may be paid to the dealer or the dealer pot for each bonus wager won, not just for each participating player who made a winning bonus wager. For example, a separate dealer payout may be paid to the dealer or the dealer pot for each winning bonus wager made by a single player. As used herein, a dealer payout to a dealer may also include a dealer payout to a dealer pool rather than a payout directly to a single particular dealer. The dealer payout may be referred to herein as a "Dealer Envy" payout. The dealer payout may be independent of the outcome of the ante wager, but rather, may be based solely on the outcome of the bonus wager. Thus, the dealer payout may be resolved prior to resolving the ante wager. The dealer payout may be a built-in dealer tip that increases as payouts to the corresponding participating player winning the bonus wager increases. The dealer payouts may be odds payouts, fixed payouts or percentage payouts of a jackpot fund.

The dealer payout may be paid directly to the dealer or may be used to fund a dealer pool. In some embodiments, the dealer payout funds a dealer pool. Funds in the dealer pool may be divided among dealers who deal a particular game or table within a particular time frame (e.g., during a shift). The funds from the dealer pool are paid directly to one or more dealers and are not paid to the house or gaming establishment. For example, the funds from the dealer pool may be distributed and divided from the dealer pool and among a plurality of dealers, who may retain their portion of the dealer pool as a tip and may not be required to return any portion thereof to the gaming establishment or casino. Thus, the dealer payout is not a house commission, a vigorish, or a rake, but is a separate payout to the dealer or a dealer pool (e.g., a toke or tip).

The dealer automatically qualifies to receive the dealer payout each time a participating player places a bonus wager, without being required to place a wager to participate. In other words, the dealer may not be required to contribute to the bonus wager or participate in the bonus game to be eligible to receive the dealer payout. The dealer may receive the dealer payout each time a participating player receives a winning outcome on the bonus wager.

The dealer payout may be independent of the outcome of the primary game and may be based solely on the outcome of the bonus wager. The odds of the dealer receiving the dealer payout may be based on, and directly related to, the odds of a participating player winning the bonus wager. However, the dealer payout may be made each time a participating player receives a winning outcome in the bonus wager. Thus, in some embodiments, more than one dealer payout may be made in a round of play, such as where more than one participating player places the bonus wager and receives a winning outcome in the bonus wager. Accordingly, the odds of a dealer payout may increase as the number of participating players who place the bonus wager increases.

The dealer payout may provide an incentive for dealers to encourage participating players to place the bonus wager. In environments where the wagering game is played on a live table, dealers may have an incentive to attract more players to their table to increase their odds of receiving the dealer payout.

The dealer payout may be funded from the side bet itself. In other embodiments, the dealer payout may be funded from a portion of one or more of the wagers (e.g., the ante wagers, the play wagers, the bonus wagers, and the side wagers) received during game play. In some embodiments, the house may fund the dealer payout (e.g., the dealer payout may be paid from commissions from a house rake or from lost wagers collected by the house). The dealer payout may be paid to the dealer pool or directly to the dealer and the player may receive the payout on the bonus wager according to a predetermined and posted paytable. The dealer payout may not affect the payout of the bonus wager to the player. Thus, in some embodiments, the dealer payout does not decrease the payout to the participating player who wins the corresponding bonus wager.

The amount of the dealer payout may increase as the payout to participating players who receive a winning outcome in the bonus wager increases. Thus, the dealer payout may be, for example, a built-in dealer tip that increases as the payout to participating players winning the bonus wager increases. When a player wins the bonus wager, an amount in addition to the odds payout that is paid to the player may be paid to the dealer. In some examples, the dealer payout may be a fixed dollar amount, regardless of the amount of the bonus wager associated with the dealer payout. For example, a payout to a player winning the bonus wager may be an odds payout and the associated payout to the dealer pool or the dealer may be a fixed dollar payout. As a nonlimiting example, the dealer payout may be paid according to the payouts shown in Table II.

TABLE II

| Five-Card Hand | Player Payout | Dealer Envy Payout |
|---|---|---|
| Royal Flush | 500 to 1 | $100 |
| Straight Flush | 200 to 1 | $25 |
| Four-of-a-kind | 50 to 1 | $10 |
| Full House | 25 to 1 | $5 |
| Flush | 12 to 1 | $3 |
| Straight | 8 to 1 | $1 |
| Three-of-a-kind | 5 to 1 | 0 |

In other embodiments, the dealer payout may not be a fixed amount corresponding to a particular winning outcome for a player, but may be an odds payout based on the amount of money wagered by the corresponding participating player. For example, the dealer payout may be paid as shown in Table III.

TABLE III

| Five-Card Hand | Player Payout | Dealer Envy Payout |
|---|---|---|
| Royal Flush | 500 to 1 | 100 to 1 |
| Straight Flush | 200 to 1 | 25 to 1 |
| Four-of-a-kind | 50 to 1 | 10 to 1 |
| Full House | 25 to 1 | 5 to 1 |
| Flush | 12 to 1 | 2 to 1 |
| Straight | 8 to 1 | 1 to 1 |
| Three-of-a-kind | 5 to 1 | 0 |

After the bonus wager has been resolved and any bonus payouts to participating players and the dealer or the dealer pool have been paid, the ante wager and the play may be resolved, as indicated at operation 120. In other embodiments, the bonus wager is resolved at the same time the Three Card Poker wager is resolved. The ante wager and the play wager of each participating player may be resolved based on the rules of the primary game. For example, the set of player cards of each participating player who placed the ante wager and the play wager may be compared to the set of dealer cards. Players with winning hands may receive a payout based on the rules of the primary game. By way of nonlimiting example, players with a three-card hand having a higher poker rank than a poker rank of the dealer's three-card hand may receive a payout on the ante wager and the play wager. In some embodiments, a player who wins the ante wager and the play wager may receive a payout of 1:1 for each of the ante wager and the play wager.

After the ante wager and the play wager of each participating player have been resolved based on the game rules of the ante wager, the optional side wager may be resolved based on rules of the side wager, as indicated at operation 122. A player may win the side wager even if the player did not place an ante wager or folded the ante wager. In other embodiments, optional side wagers may be resolved during operation 112 when the bonus wager is resolved. Each participating player who placed the optional side wager and who has a winning outcome in the side wager may be paid a payout according to a paytable. For example, the side wager may be paid according to the payouts shown in Table IV for various Three Card Poker hands.

TABLE IV

| Player Hand | Player Payout |
|---|---|
| Straight Flush | 40 to 1 |
| Three-of-a-kind | 25 to 1 |
| Straight | 6 to 1 |
| Flush | 4 to 1 |
| Pair | 1 to 1 |

After the ante wager, the play wager, the bonus wager, and the optional side wager (if any) have been resolved and winning payouts paid to any qualifying participating player(s), any losing ante wager, play wager, bonus wager, or optional side wager may be retained by the casino or other gaming establishment, as indicated at operation 124. As will be explained in more detail below, alternatively, the operation 124 of retaining the wagers may be replaced by an operation of periodically returning at least a portion of an accumulating pot comprising multiple wagers to one or more participating players, rather than to the casino or other gaming establishment.

In some examples, the bonus wager may be resolved independently from the ante wager, the play wager, and the optional side wager and regardless of whether the participating player wins or loses in the ante wager, the play wager, or the side wager.

Although the method 100 of administering a wagering game illustrated in FIG. 1 has been described as following a particular sequence, the present disclosure is not so limited. In some embodiments, the bonus wager may be resolved after resolving the ante wager, and the play wager, as in operation 120. Such an embodiment may be beneficial where it is desired for each player card set to remain unrevealed until after resolving the ante wager and play wager (such as where players also play against other participating players). Thus, any outstanding bonus wager may be resolved at any convenient time during a game round after a bonus wager has been accepted from at least one participating player. For example, the bonus wager may be resolved before or after allowing each participating player the option to take action according to the rules of the primary game, as in operation 112.

Although the primary game has been described above as a three-card poker game and the bonus wager has been described as the "6 Card Bonus" wager, the present disclosure is not so limited. For example, the primary game may be any game in which a bonus or side wager may be placed. Nonlimiting examples of the primary game include blackjack, War, baccarat, poker (two-card poker, four-card poker, five-card poker, Texas hold 'em, Omaha hold 'em, lowball, etc.), pai gow poker, or any other primary game that may include one or more optional bonus wagers.

Although the bonus wager with dealer envy payouts has been described above as a particular bonus wager implemented in the "6 Card Bonus" game in an underlying poker game, the bonus wager may be any bonus wager and may be implemented in any underlying game. Specifically, the dealer payout may be paid to a dealer or dealer pool in any game where a participating player places a bonus wager and receives a winning outcome in the bonus wager. In some embodiments, participating players may place more than one bonus wager in a round of play. The dealer envy payout may be made for each bonus wager for which each participating player obtains a winning outcome. Thus, more than one dealer payout may be paid to the dealer for each participating player in a round of play, such as when the participating player places more than one bonus wager and obtains a winning outcome in more than one of the bonus wagers.

The wagering game may include any combination of bonus wagers that qualify for the dealer payout and side wagers that do not qualify for the dealer payout. For example, in some embodiments, the wagering game may include a primary game, one or more bonus wagers for which the dealer may qualify for a dealer payout, and one or more side wagers for which the dealer may not qualify for the dealer payout.

The bonus wager may be based on the initial set of playing cards dealt to each participating player, the initial set of playing cards dealt to the dealer, any cards that may be dealt to a community area, and combinations thereof. Nonlimiting examples may include games in which the total number of cards dealt to the dealer and a participating player sums to six, games in which at least five cards (e.g., five, six, seven, etc.) are dealt to a participating player, the dealer, or both. Other embodiments may include poker side wagers, based on the initial cards dealt to the player and a predetermined number of community cards (e.g., a player's initial hand and a number of community cards such that the player has a five-card hand). In other embodiments, the bonus wager may be based on the player's initial cards and community cards, or the player's cards and the dealer's cards, such as in Texas hold 'em, Omaha hold 'em, etc., seven card stud, five-card stud, etc. Bonus wagers may also be resolved by comparing a dealer hand to a paytable, comparing any combination of dealer and player cards to a paytable, comparing community cards to a player hand, dealer hand or a paytable, and any other known method of resolving a side wager. If the base game is pai gow poker or a variant of pai gow poker, the side bet may be resolved by combining two or more player hands to form a best poker hand, such as a best five out of seven card poker hand, for example. In another embodiment, if the base game is pai gow poker, a bonus wager may be placed that the player's five of the seven cards dealt to the player will form a predetermined five-card poker hand.

In other embodiments, the bonus wager may be based on card ranking systems such as War rankings (e.g., high card rankings), poker rankings (e.g., two-card poker rankings, three-card poker rankings, four-card poker rankings, five-card poker rankings, Texas hold 'em rankings, Omaha hold 'em rankings, lowball poker rankings, etc.), baccarat scoring, a number of cards in a straight, number of cards in a flush, etc. For example, the bonus wager may be based on a point difference between a player's first card and a dealer's first card. In other embodiments, the bonus wager may be based on three-card poker rankings, such as poker rankings of the initial three cards held by the dealer (e.g., an insurance wager, a bad beat wager, etc.). For example, the bonus wager may be based on the dealer's hand (e.g., the dealer's three-card hand). A dealer hand of a royal flush may receive a highest payout. A three-of-a-kind may receive the next highest payout, followed by a straight, a flush, and a pair. A pair of aces may receive a higher payout than a pair of kings, queens, jacks, tens, etc., with a pair of twos being the lowest ranked pair.

In yet other embodiments, the bonus wager may be based on four-card poker rankings (e.g., four-of-a-kind, a flush, a straight, a three-of-a-kind, two pair, or one pair). For example, a four-card hand may be formed from the cards dealt to each participating player and the cards dealt to the dealer. The bonus hand may also be formed from a combination of player cards and community cards. In other embodiments, the bonus wager may be based on the number of cards in a straight or flush based on a four-card hand made up of each participating player's first two cards and the first two cards of the dealer.

For example, the primary game may include baccarat, War, poker, pai gow poker, etc. Where the primary game includes baccarat, the bonus wager may include a DRAGON BONUS BACCARAT™ wager wherein players place a wager that the Banker hand will win or that the Player hand either will win on a "natural" (i.e., when the initial two cards dealt to the Banker, to the Player, or both total a score of eight or nine) or will win by a point spread of at least four points. The bonus wager may be based on a wager that the Banker hand will win with a three-card score of seven (the "Dragon 7" wager), or that the Player hand will win with a three-card score of eight (the "Panda 8" wager) bets offered in the game EZ BACCARAT, for example.

In some embodiments, the bonus wager may have a house advantage, such that the dealer accepts the bonus wager without requiring the acceptance of a base game wager. The bonus wager can pay odds payouts for predetermined winning hand compositions, and a fixed dealer envy payout for at least one predetermined winning hand. In examples of the invention, the bonus wager funds both the odds payouts to the winning player and the fixed payouts to the dealer. The dealer may also receive odds payouts instead of fixed amount payouts.

In examples of the invention, the dealer or dealer pool receives a payout on less than all winning player hands. For example, if a player achieved a winning hand with low payout odds, such as 2:1 or 1:1, the dealer may not receive a payout. In other examples, the dealer or a dealer pool receives a payout whenever a payout is paid by the dealer to a player.

Various platforms are contemplated that are suitable for implementation of embodiments of wagering games according to this disclosure. For example, embodiments of wagering games may be implemented as live table games with an in-person dealer, electronic gaming machines, partially or fully automated table games, and partially or fully automated, network-administered games (e.g., Internet games) wherein game results may be produced utilizing a processor or a live video feed of a dealer administering a game from a remote studio. By way of further example, wagering games may be implemented on gaming tables, which may include physical gaming elements, such as physical cards and physical chips, printed betting circles and other designated play areas, and may include a live dealer and a shuffler or shoe. More specifically, a live dealer may deal physical cards, evaluate hands, accept wagers, accept player elections, issue payouts, retain wagers, and perform other administrative functions of game play. Some embodiments may be implemented on electronic devices enabling electronic gaming features, such as providing electronic displays for display of virtual cards, virtual chips, game instructions, paytables, etc. Some embodiments may include features that are a combination of physical and electronic features.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, on a legally authorized site on the Internet, or on a play-for-fun site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

Figure 2:
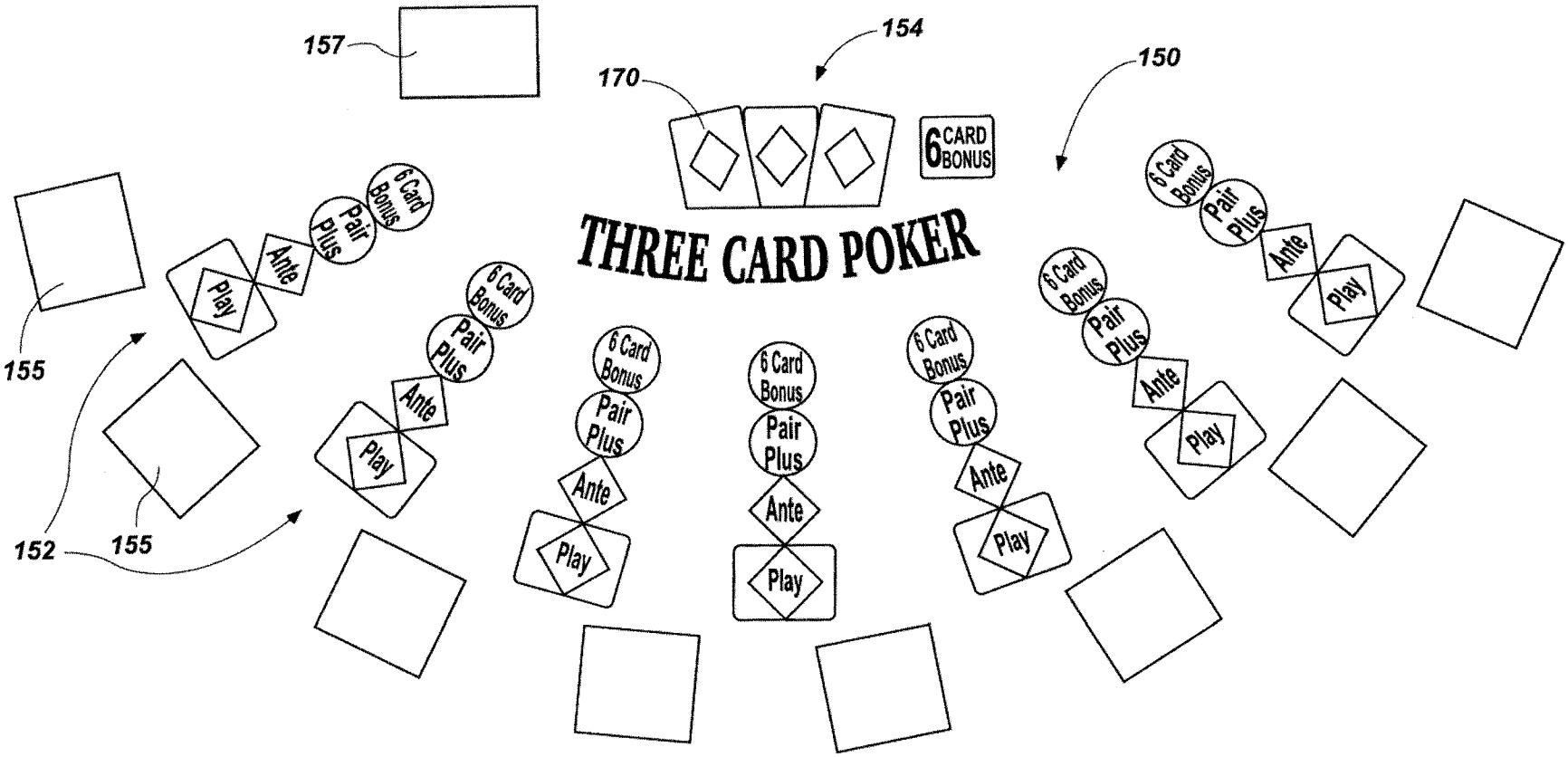
FIG. 2 is a diagram of a playing surface for implementation of a method of administering a wagering game, according to an embodiment of this disclosure.

Referring to FIG. 2, an embodiment of a diagram of a playing surface 150 (also referred to as a "gaming table layout 150") having one or more player positions 152 and a dealer card position 154 for implementation of the wagering games within the scope of the present disclosure is shown. Such an implementation may include a felt layout with printed markings on a physical gaming table or an electronic representation of a felt layout on a video display screen (see, e.g., FIGS. 5 through 7, and 9) for each participating player position 152. The playing surface 150 may define a plurality of the participating player positions 152 within which the activity (e.g., wagering and card dealing) for individual players may take place. The dealer card position 154 may be a position where dealer cards may be dealt. For example, the dealer card position 154 may include an area where a number of cards of a dealer hand may be dealt and positioned, such as an area sufficiently large to position all of the dealer cards side by side in a row.

Figure 2A:
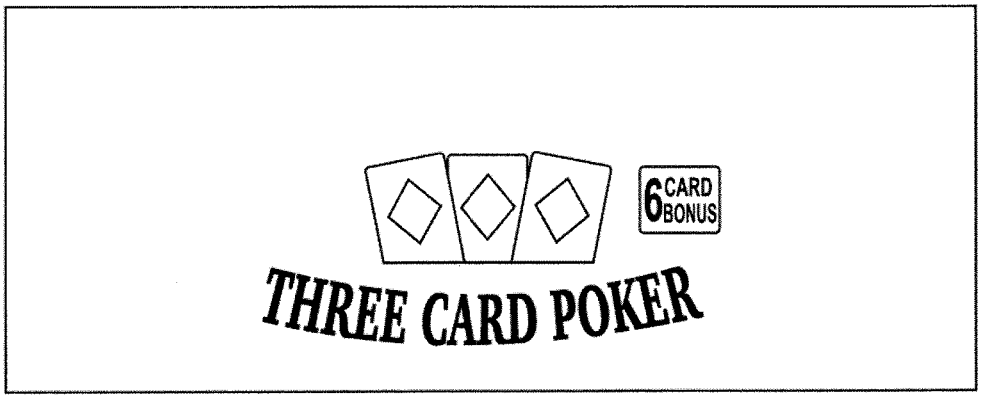
FIG. 2A is an exemplary paytable illustrating winning hands, payout odds and dealer envy payouts.

One or more of the participating player positions 152 and the dealer card position 154 may include one or more indicia related to the wagering game. For example, each of the participating player positions 152 and the dealer card position 154 may include a paytable 155 indicating the odds associated with the payouts for one or more of the wagers (e.g., the bonus wager, the optional side wager, etc.). The gaming table layout 150 may include a logo 170 of the primary game, such as the "Three Card Poker™" logo. The gaming table layout 150 may also include an indication such as a paytable 157 that the dealer may receive a payout when the player receives one or more payouts on the bonus wager, such as, for example, a paytable similar to Table II or Table III. In other embodiments, the paytable that includes "envy" bonus payoffs for the dealer are included in signage such as shown in FIG. 2A. Although the logo 170 is shown in only one location on the gaming table layout 150, the logo 170 may be located anywhere on the gaming table layout 150 and the gaming table layout 150 may include more than one logo 170 (e.g., such as at each participating player position 152 or next to the dealer card position 154).

Figure 3:
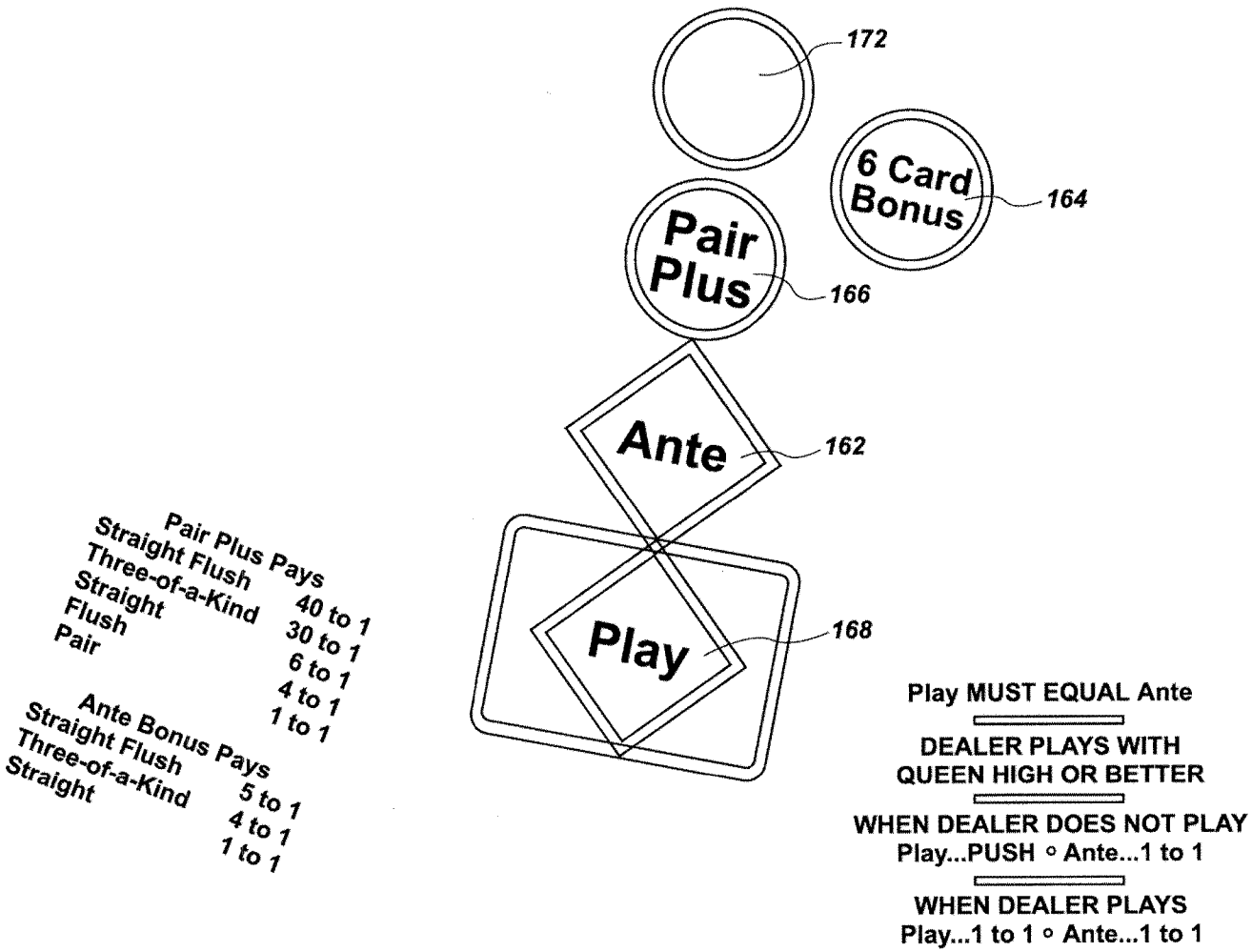
FIG. 3 is an enlarged diagram of a wagering area of a player position on the playing surface of FIG. 2.

Referring to FIG. 3, an enlarged diagram of one of the player positions 152 of the playing surface 150 of FIG. 2 is shown. Each player position 152 (FIG. 2) may include an ante wager region 162 within which money or representations of money may be placed or displayed (e.g., physically positioned or digitally displayed) when the ante wager is accepted to play a base game. Each player position 152 may also include a bonus wager region 164 within which a bonus wager may be placed or displayed when the bonus wager is accepted. Each player position 152 may further include an optional side wager region 166 within which a side wager may be placed or displayed when the side wager is accepted. Each player position 152 may also include a play wager region 168 within which a play wager may be placed or displayed when the play wager is accepted. Each player position 152 may also include an optional progressive wager region 172 within which a progressive wager (which is described in more detail below) may be placed or displayed when the progressive wager is accepted. The layout 150 (FIG. 2) may include a bonus paytable 155 that may display winning bonus hands and corresponding payout odds. The bonus paytable 155 (FIG. 2) may also display the payouts to the dealer or dealer pool when the player wins the bonus wager. As is known in the art, the odds are multiplied by the amount wagered to determine a payout amount. The paytable 155 may be altered according to the bonus wager of the particular game.

In some embodiments, one or more of the wager regions such as progressive wager area 172 may include sensors to automatically sense the presence and/or value of a wager. If a player wishes to make a progressive wager, a wager or token is accepted in area 172 on the layout. Table V provides payouts for predetermined winning combinations on the progressive wager:

TABLE V

| Hand | Pays* | Envy* |
|---|---|---|
| Royal Spades | 100% | $100 |
| Royal Other | 25% | $50 |
| Straight Flush | 250 | |
| 4 of a Kind | 100 | |
| Full House | 20 | |
| Flush | 10 | |
| Straight | 2 | |
| Hold | 24.87% | |
| Hit Frequency | 3.68% | |

*Payouts increase with higher denomination bets

With combined reference to FIGS. 2A, 2 and 3, a specific implementation of the wagering game described in connection with FIG. 1 is presented. An ante wager may be accepted from each participating player position 152 by receiving money or representations of money (e.g., chips) in the ante wager region 162. A bonus wager may be accepted by receiving money or representations of money in the bonus wager region 164. In some embodiments, another side wager (i.e., another bonus bet) may be accepted by receiving money or representations of money in the side wager region 166. For example, the side wager may be based on an occurrence of the player's three-card poker hand having a predetermined poker value, such as in the Pair Plus wager. A player may win the side wager when the player has a three-card poker hand with a rank of a pair or higher. A player who receives a winning outcome on the side wager may receive a payout according to a paytable, such as Table IV. A progressive wager may optionally be accepted by receiving money or representations of money in the progressive wager region 172. In embodiments, at least one bonus wager is accepted from one of the participating player positions 152. For example, the dealer may accept a bonus wager in bonus wager region 164. In some embodiments, the ante wager may be required for a player to place the bonus wager. After the ante wager, at least one bonus wager, an optional side wager, and an optional progressive wager from one of the participating players have been elected and received in their respective positions, a number of player cards (e.g., one player card, two player cards, three player cards, four player cards, five player cards, six player cards, seven player cards, or more or less) may be dealt to a player card position (e.g., below, above, or on the player position 152 in the perspective of FIG. 3) of each participating player position 152. In some embodiments, one or more player cards may be dealt face up, while in other embodiments, the player cards may be dealt face down. An equal number of dealer cards may be dealt to the dealer card position 154. In some embodiments, one or more of the dealer cards may be dealt face up.

Cards used in games of the present invention may be standard playing cards, each deck having four suits (clubs, hearts, diamonds and spades) and having rankings Ace, King, Queen, Jack, 10, 9, 8, 7, 6, 5, 4, 3, 2. Cards used in games of the present invention may be randomized in a card-handling device that utilizes a random number generator to determine the desired card order.

Cards may also be dispensed from a shuffler such as one that provides a continuous supply of cards dealt individually into a card game, such as cards dispensed from a One2Six® shuffler marketed by Bally Gaming, Inc. of Las Vegas, Nev., and disclosed in U.S. Pat. No. 6,659,460 (RE 42,944), issued Dec. 3, 2013, issued to Blaha et al., the disclosure of which is incorporated herein in its entirety by this reference.

After the set of player cards and the set of dealer cards have been dealt, each participating player may be allowed to take action related to the primary game and the optional side wager is made. In some embodiments, where the primary game is three-card poker, after inspecting his or her set of player cards, each participating player may decide to place a play wager to remain in the play of the primary game, or may decide to fold, according to the house rules. For example, the dealer may receive an election from each participating player that the player wishes to remain in the game by observing the player place a play wager in the play wager region 168 or an indication that the player wishes to fold by observing the player turn over his or her cards. The play wager may be a multiple of the ante wager and may, in some embodiments, be an amount equal to the ante wager.

After all players have acted by either folding or placing the play wager, any dealer cards that are unrevealed may be revealed. In some embodiments, the dealer's hand may include three cards, initially dealt face-down. After players have acted by either folding or placing a play wager, all of the dealer cards may be revealed.

After players have taken action related to the primary game or the optional side wagers, the bonus wager placed in circle 164 of each participating player who placed a bonus wager in the bonus wager region 164 may be resolved according to the set of player cards of that player, the set of dealer cards, and a predetermined paytable. By way of example and not limitation, the bonus wager may be resolved, and a fixed odds payout paid, according to a bonus paytable (see, e.g., Table I above).

The bonus payout may be paid to any participating player who has elected to make the bonus wager prior to receiving his or her player cards and whose hand, in combination with the dealer's hand, forms a predetermined winning five-card poker rank according to the bonus paytable. For example, the bonus wager may be resolved by the dealer selecting at least some of the cards in the player's hand and at least some of the cards in the dealer's hand to form a highest ranking bonus hand using five-card poker rankings, and optionally one or more six card hands. The bonus hand may include any number of cards. In some embodiments, the bonus hand is a five-card hand. A five-card poker hand may be formed from the best cards of the three cards in a player hand and the three cards in the dealer hand. In one embodiment, for any participating player whose three cards combined with the dealer's three cards (e.g., bonus hand) does not form a predetermined five-card poker rank that participating player's bonus wager may be retained by the house.

After settling any bonus wagers or concurrently with settling bonus wagers of each participating player, the dealer payout may be resolved by paying at least one of the dealer and a dealer pool a payout for certain player bonus payouts. By way of example and not limitation, the dealer payout may be resolved, and a fixed dollar amount paid, according to a dealer payout table (see, e.g., Table III above).

After the dealer has taken any dealer action according to house rules, the ante wager and play wager of any participating player remaining in the primary game may be resolved. The ante wager and play wager may be resolved according to house rules. In some embodiments, the dealer must qualify with a certain hand rank or better to remain in play. For example, a three-card hand of a queen high or better may qualify the dealer to play against the player. Where the dealer does not have a qualifying hand, the player may win even money on the ante wager and the play wager may push (e.g., the player's play wager may be returned to the player). In other embodiments, even money is paid on the play wager and the ante wager pushes.

After the ante wager and the play wager have been resolved, the side wager may be resolved according to house rules. In some embodiments, a player may obtain a winning outcome in the side wager even if the player did not place the ante wager or the play wager. The side wager may be resolved and a payout may be paid to a player who obtained a winning outcome according to a paytable, such as Table IV.

After any remaining portions of the ante wager, the play wager, the bonus wager, the optional side wagers, and the optional progressive wager are resolved and payouts (if any) are paid and/or wagers collected and retained, the player cards and dealer cards may be collected and the game round ended.

In some embodiments, the fixed odds payout of the ante wager, the bonus wager, and the optional side wagers, and/or the combinations thereof, may be adjusted based on a number of cards or decks of cards used in the game play. Thus, the game may be played with any number of cards or decks of cards, such as a with a single 52-card deck, two 52-card decks, three 52-card desks, four 52-card decks, five 52-card decks, six 52-card decks, seven 52-card decks, eight 52-card decks, decks with one or more jokers, etc. Given the number of cards or decks of cards, the bonus paytable and the dealer payout table may be adjusted based on the odds of obtaining the winning hand(s). Additionally, other hands may be added to the paytable, such as five of a kind, which is not possible when administering a single deck game. Thus, a card shuffler, dealing shoe, stack, or digital file containing any number of cards or representations of cards may be used with embodiments of the present disclosure.

The method 100 of administering the game of the present disclosure, as described above with reference to FIGS. 1 through 3, may be based solely on the occurrence or non-occurrence of a winning outcome of the bonus wager in some embodiments. In other words, the dealer payout may be based solely on the occurrence or non-occurrence of a participating player receiving a winning outcome in the secondary game (e.g., the bonus wager) and receiving a payout based on the bonus wager. In some embodiments, the ante wager is required to play the game. In other embodiments, only one of the ante wager and a side wager (e.g., the Pair Plus wager) is required to play the game. In yet other examples, the ante and all side bets are mandatory bets.

In some embodiments, the wagering games described herein may be played against a game administrator (i.e., against "the house" such that the game is "house-banked"). Such implementations may involve the game administrator (e.g., a casino or other gaming establishment) accepting (e.g., via a dealer or other agent of the administrator) wagers of real-world monetary value, distributing payouts of real-world monetary value on winning wagers to players, and collecting real-world monetary value of lost wagers. Such "house-banked" embodiments may be implemented, for example, in the form of a live table game, in a virtual table game, in an electronic game, or in a networked (e.g., Internet) game configuration.

In other embodiments, the wagering games, or at least one wager associated with the wagering games, may involve a player in a casino or other gaming establishment acting as banker, accepting wagers having real-world monetary value, issuing payouts having real-world monetary value, and collecting real-world monetary value of lost wagers (i.e., be "player-banked"). In some embodiments where at least one wager is player-banked, the game administrator may collect a player entrance fee, a seat rental fee, or a rake on each player-banked wager, accepted from the participating players, including the banker.

Figure 4:
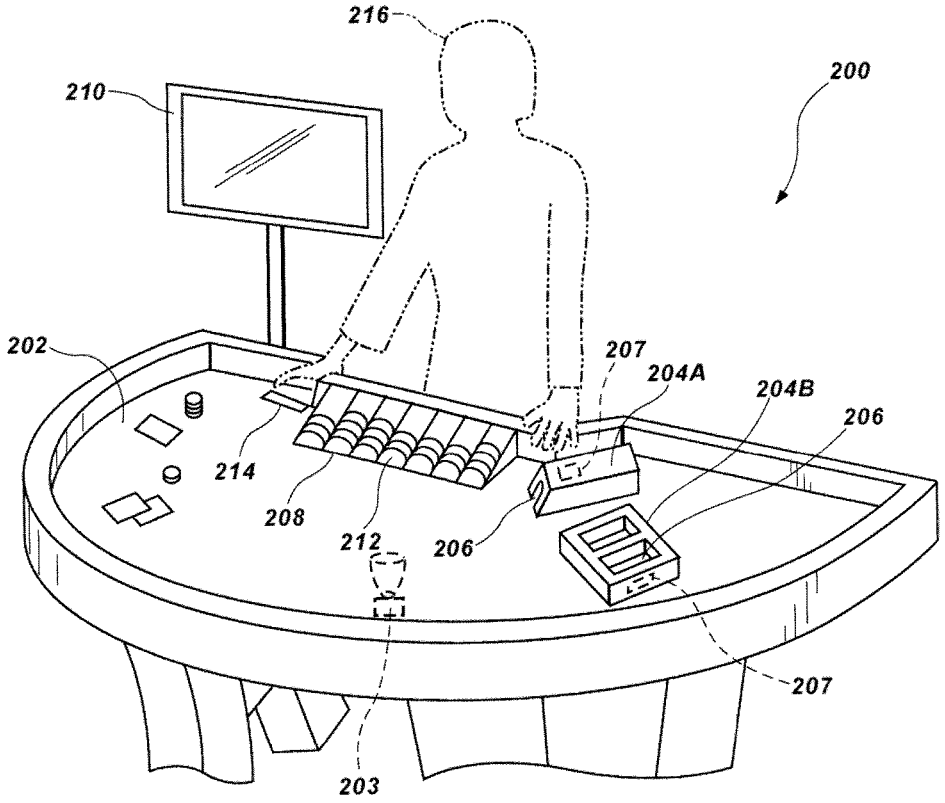
FIG. 4 is a perspective view of a gaming table configured for implementation of embodiments of wagering games in accordance with this disclosure.

FIG. 4 is a perspective view of an embodiment of a gaming table 200 for implementing wagering games in accordance with this disclosure. The gaming table 200 may be a physical article of furniture around which participants in the wagering game may stand or sit and on which the physical objects used for administering and otherwise participating in the wagering game may be supported, positioned, moved, transferred, and otherwise manipulated. For example, the gaming table 200 may include a gaming surface 202 on which the physical objects used in administering the wagering game may be located. The gaming surface 202 may be, for example, a felt fabric covering a hard surface of the gaming table 200, and a design, conventionally referred to as a "layout," specific to the game being administered may be physically printed on the gaming surface 202. As another example, the gaming surface 202 may be a surface of a transparent or translucent material (e.g., glass or plexiglass) onto which a projector 203 (shown in dashed lines), may be located, for example, above or below the gaming surface 202. The projector 203 may illuminate layout markings specific to the wagering game being administered. In such an example, the specific layout projected onto the gaming surface 202 may be changeable, enabling the gaming table 200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 202 may include, for example, designated areas for player positions; areas in which one or more of player cards, dealer cards, or community cards may be dealt; areas in which wagers may be accepted; areas in which wagers may be grouped into pots; and areas in which rules, paytables, and other instructions related to the wagering game may be displayed. As a specific, nonlimiting example, markings on the gaming surface 202 may be configured as shown in FIGS. 2 and 3.

In some embodiments, the gaming table 200 may include a display 210 separate from the gaming surface 202. The display 210 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor). In examples of the invention, upright display 210 displays a paytable that illustrates winning hands, payout odds and dealer pays (i.e., tips) for winning six card bonus side bet hands.

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time. Such a card-handling device 204A may include a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent Application Publication No. 2010/0038849, published Feb. 18, 2010, and titled "INTELLIGENT AUTOMATIC SHOE AND CARTRIDGE," the disclosure of which is incorporated herein in its entirety by this reference.

The card-handling device 204B may be, for example, a shuffler configured to reorder physical cards 206 from one or more decks of playing cards and present randomized cards 206 for use in the wagering game. Such a card-handling device 204B may include, for example, a housing, a shuffling mechanism configured to shuffle cards, and card inputs and outputs (e.g., trays). Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 Patent may include card recognition capability and may form randomly ordered hands of a known composition within the shuffler. Additionally, game rules may also be programmed within the shuffler such that the processor of the shuffler is capable of identifying a winning hand prior to automatic delivery into an output tray. The card-handling device 204 may also be, for example, a combination shuffler and shoe in which the output for the shuffler is a shoe.

In some embodiments, the card-handling device 204 may be configured and programmed to administer at least a portion of a wagering game being played utilizing the card-handling device 204. For example, the card-handling device 204 may be programmed and configured to randomize a set of cards and dispense one or more randomly ordered cards for use according to game rules. More specifically, the card-handling device 204 may be programmed and configured to, for example, randomize a set of cards including one or more 52-card decks of standard playing cards and, optionally, any specialty cards (e.g., a cut card, bonus cards, wild cards, or other specialty cards). In some embodiments, the card-handling device 204 may present individual cards, one at a time, for withdrawal from the card-handling device 204. In other embodiments, the card-handling device 204 may present packets of randomly ordered cards representing a subset of the complete set of cards handled by the card-handling device 204 (e.g., individual hands, a group of hands, a partial hand or hands, community cards, dealer hand, a dealer partial hand and then additional cards as needed to complete the hand or hands, and any extra cards to be used in the same round as the hand or hands) for withdrawal from the card-handling device 204. In some such embodiments, the card-handling device 204 may accept dealer input, such as, for example, a number of hands to dispense, a number of partial hands to dispense, a number of replacement cards for discarded cards, a number of hit cards to add, or a number of replacement cards or hands to dispense. In other such embodiments, the device may accept a dealer input from a menu of game options indicating a game selection, which will select programming to deliver the requisite number of cards to the game, and the timing of delivery, depending on the game rules. The game rules may be programmed into the memory of the shuffler processing system. In still other embodiments, the card-handling device 204 may present the complete set of randomized cards for withdrawal from the card-handling device 204. As specific, nonlimiting examples, the card-handling device 204 may present a packet of cards representing a single hand, a partial hand or a packet of cards representing a group of hands, such as a group of cards used in games such as Pai Gow Poker, where the dealer permits the player to split the group into a high and low hand.

Packets of cards used as player hands, partial player hands, dealer hands, partial dealer hands, community cards, or other card groups may be formed internally within the shuffler, such as within an internal compartment, as described in the '574 Patent, or may be formed in an output tray of the shuffler. For example, U.S. Pat. No. 6,698,756, issued Mar. 2, 2004, to Baker et al. describes such a device. Other suitable shufflers include U.S. Pat. No. 6,267,248, issued Jul. 31, 2001, to Johnson et al., which describes a shuffler that can form a random set of cards, such as a deck or multiple decks; U.S. Pat. No. 7,766,332, issued Aug. 3, 2010, to Grauzer et al., which describes forming groups of player and/or dealer cards in compartments within a shuffler; U.S. Patent App. Pub. No. 2014/0027979, published Jan. 30, 2014, to Stasson et al., which shows an alternative method of randomly forming a set of cards in a shuffler such as one or more decks of cards; and U.S. Pat. No. 6,588,750, issued Jul. 8, 2003, to Grauzer et al., which shows a device for randomizing a set of cards using a gripping, lifting and insertion sequence. The disclosure of each of the foregoing documents is incorporated herein in its entirety by this reference.

In some embodiments, the card-handling device 204 may employ a random number generator device to determine card order, such as, for example, a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Other functions of the random number generator may be game-specific. For example, a random number generator internal or external to the shuffler may be used to randomly select a player to receive a first packet of cards, including a hand or a portion of a hand, according to the game rules. In other examples, the random number generator may select a game position to receive an extra card, one less card, or a random number of cards, depending upon the specific rules of the game.

The random number generator may be implemented as software or may be implemented in hardware such as a hardwired circuit or FPGA logic board. Regardless of whether the random number generator is hardware or software, it may be used to implement specific game administrations methods of the present disclosure.

The card-handling device 204 may simply be supported on the gaming surface 202 in some embodiments. In other embodiments, the card-handling device 204 may be mounted into the side of or into an aperture in the surface of the gaming table 202 such that the card-handling device 204 is not manually removable from the gaming table 202 without the use of tools. In some embodiments, the deck or multiple decks of playing cards used may be standard, 52-card decks. In other embodiments, the deck or decks used may include cards, such as, for example, jokers, wild cards, bonus cards, etc. In other embodiments, the deck can be stripped of certain cards, such as a Canasta or Spanish 21 deck. The shuffler may also be configured to handle and dispense security cards, such as cut cards.

In some embodiments, the card-handling device 204 may include an electronic display 207 (shown in dashed lines) for displaying information related to the wagering game being administered. For example, the electronic display 207 may display a menu of game options, the name of the game selected, the number of cards per hand to be dispensed, acceptable amounts for wagers (e.g., maximums and minimums), numbers of cards to be dealt to recipients, locations of particular recipients for particular cards, winning and losing wagers, paytables, winning hands, losing hands, and payout amounts. The display 207 may be positioned for viewing by the dealer, players or both. In some embodiments, information related to the wagering game may be displayed on another electronic display, such as, for example, the display 210 described previously.

The type of card-handling device 204 employed to administer embodiments of the disclosed wagering game, as well as the type of card deck employed and the number of decks, may be specific the game to be implemented. Cards used in games of this disclosure may be, for example, standard playing cards from one or more decks, each deck having cards of four suits (clubs, hearts, diamonds, and spades) and of rankings ace, king, queen, jack, and ten through two in descending order. As a more specific example, six, seven, or eight standard decks of such cards may be intermixed. Typically, six or eight decks of 52 standard playing cards each may be intermixed and formed into a set. A suitable device employing random number generation for card management and randomization is marketed under the name MD3® by Bally Gaming, Inc. of Las Vegas, Nev. Aspects of this device are described in U.S. Pat. No. 8,579,289, issued Nov. 12, 2013, to Rynda et al., and the shuffling mechanism is fully described in U.S. Pat. No. 7,677,565, issued Mar. 16, 2010, to Grauzer et al., the disclosure of each of which is incorporated herein in its entirety by this reference. After shuffling, the randomized set may be transferred into another portion of the card-handling device 204B or another card-handling device 204A altogether, such as a mechanized shoe capable of reading card rank and suit. More specifically, the shoe disclosed in, for example, U.S. Pat. No. 8,511,684, issued Aug. 20, 2013, to Grauzer et al., the disclosure of which is incorporated herein in its entirety by this reference, may be used to automatically dispense one or more cards at a time from the randomized set.

As a specific, nonlimiting example, the card-handling device 204 may comprise an automatic shuffler that is configured (i.e., programmed) to provide packets of cards (e.g., three cards making each player's initial hand and three cards making the dealer's initial hand) to the dealer.

The gaming table 200 may include one or more chip racks 208 configured to facilitate accepting wagers, transferring lost wagers to the house, and exchanging monetary value for wagering elements 212 (e.g., chips). For example, the chip rack 208 may include a series of token support rows, each of which may support tokens of a different type (e.g., color and denomination). In some embodiments, the chip rack 208 may be configured to automatically present a selected number of chips using a chip-cutting-and-delivery mechanism. Additional details of an illustrative chip rack 208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 200 may include a drop box 214 for money that is accepted in exchange for wagering elements 212. The drop box 214 may include, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

When administering a wagering game in accordance with embodiments of this disclosure, a dealer 216 (shown in phantom) may receive money (e.g., cash) from a player in exchange for wagering elements 212. The dealer 216 may deposit the money in the drop box 214 and transfer physical wagering elements 212 to the player. The dealer 216 may accept one or more initial wagers (e.g., antes and other wagers) from the player, which may be reflected by the dealer 216 permitting the player to place one or more wagering elements 212 or other wagering tokens (e.g., cash) within designated areas (i.e., see FIG. 3) on the gaming surface 202 associated with the various wagers of the wagering game. Once initial wagers have been accepted, the dealer 216 may remove physical cards 206 from the card-handling device 204 (e.g., individual cards, packets of cards, or the complete set of cards after manually or automatically shuffling the deck) in some embodiments. In other embodiments, the physical cards 206 may be hand-pitched (i.e., the dealer 216 may optionally shuffle the cards 206 to randomize the set and may hand-deal cards 206 from the randomized set of cards). The dealer 216 may position cards 206 within designated areas on the gaming surface 202, which may designate the cards 206 for use as individual player cards, community cards, or dealer cards in accordance with game rules. House rules also may allow the player to place initial wagers during card distribution, or after card distribution, but before revealing the cards.

After dealing the cards 206, and during play, according to the game rules, any additional wagers (e.g., play bets, depending on the primary game) may be accepted, which may be reflected by the dealer 216 permitting the player to place one or more wagering elements 212 within designated areas on the gaming surface 202 (i.e., see FIG. 3) associated with the various wagers of the wagering game. In some embodiments, a player may fold, which may result in the dealer 216 collecting at least one of the wagering elements 212 from that player and transferring it to the house, which may be reflected by the wagering element 212 being returned to the chip rack 208. The dealer 216 may perform any additional card dealing and rounds of betting permitted in the wagering game. Finally, the dealer 216 may resolve the wagers, award winning wagers to the players, which may be accomplished by giving wagering elements 212 from the chip rack 208 to the players, and transferring losing wagers to the house, which may be accomplished by moving wagering elements 212 from the designated wager area to the chip rack 208.

Figure 5:
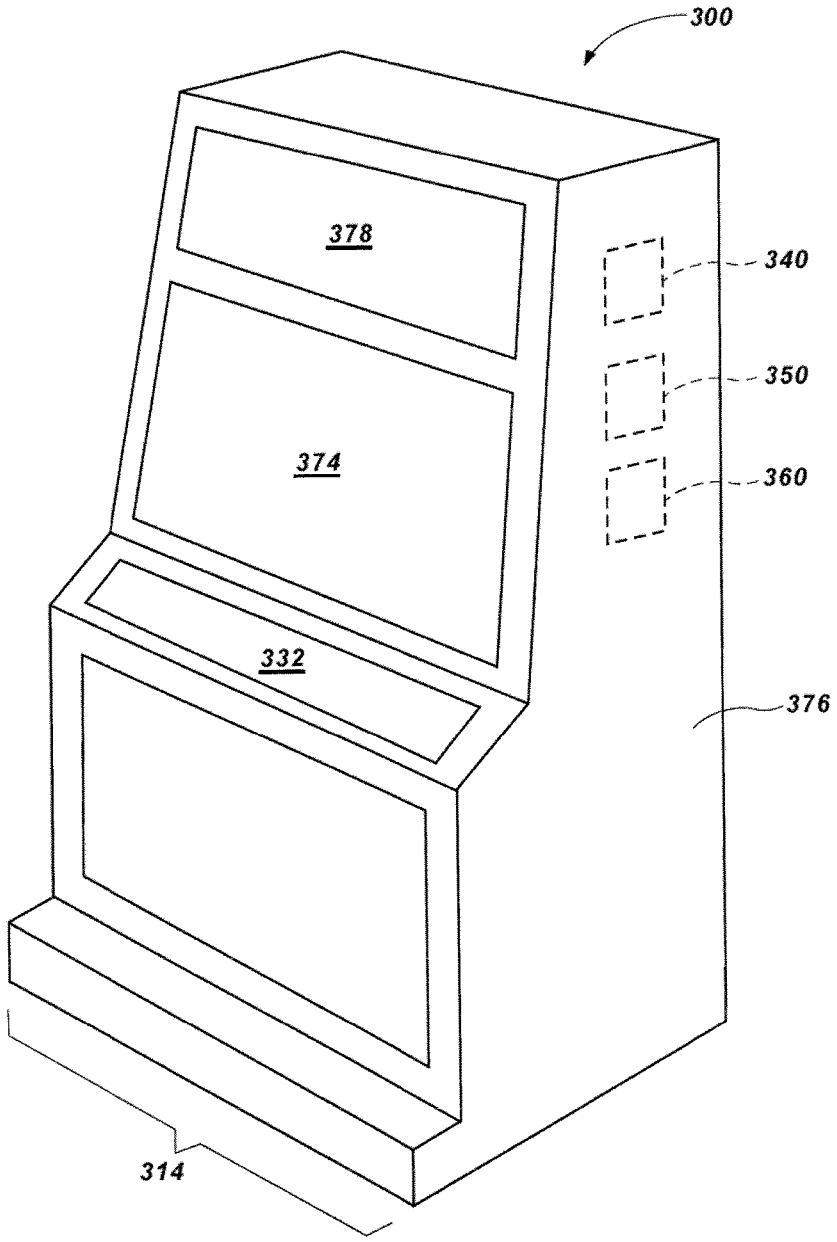
FIG. 5 is a perspective view of an individual electronic gaming device or machine (EGM) configured for implementation of embodiments of wagering games in accordance with this disclosure.

FIG. 5 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play and display game play events and indicia at the individual electronic gaming device 300. Accordingly, game play may be accommodated without involving physical playing cards, chips or other wagering elements, and live personnel. The action may instead be simulated by a control processor 350 operably coupled to the memory 340 and interacting with and controlling the individual electronic gaming device 300. Although the game play may be accommodated without involving live personal, the game play may still include a dealer payout, payable to a dealer pool. The dealer payout may fund a dealer pool from which dealers dealing at a live table (e.g., a live table playing the same game as the electronic gaming device 300) may receive dealer tips.

Although the individual electronic gaming device 300 displayed in FIG. 5 has an outline of a traditional gaming cabinet, the individual electronic gaming device 300 may be implemented in other ways, such as, for example, client software downloaded to a portable device, such as a smartphone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices, such as a server, through a suitable communication medium, such as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play. Further detail of an example of an individual electronic gaming device 300 (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 6:
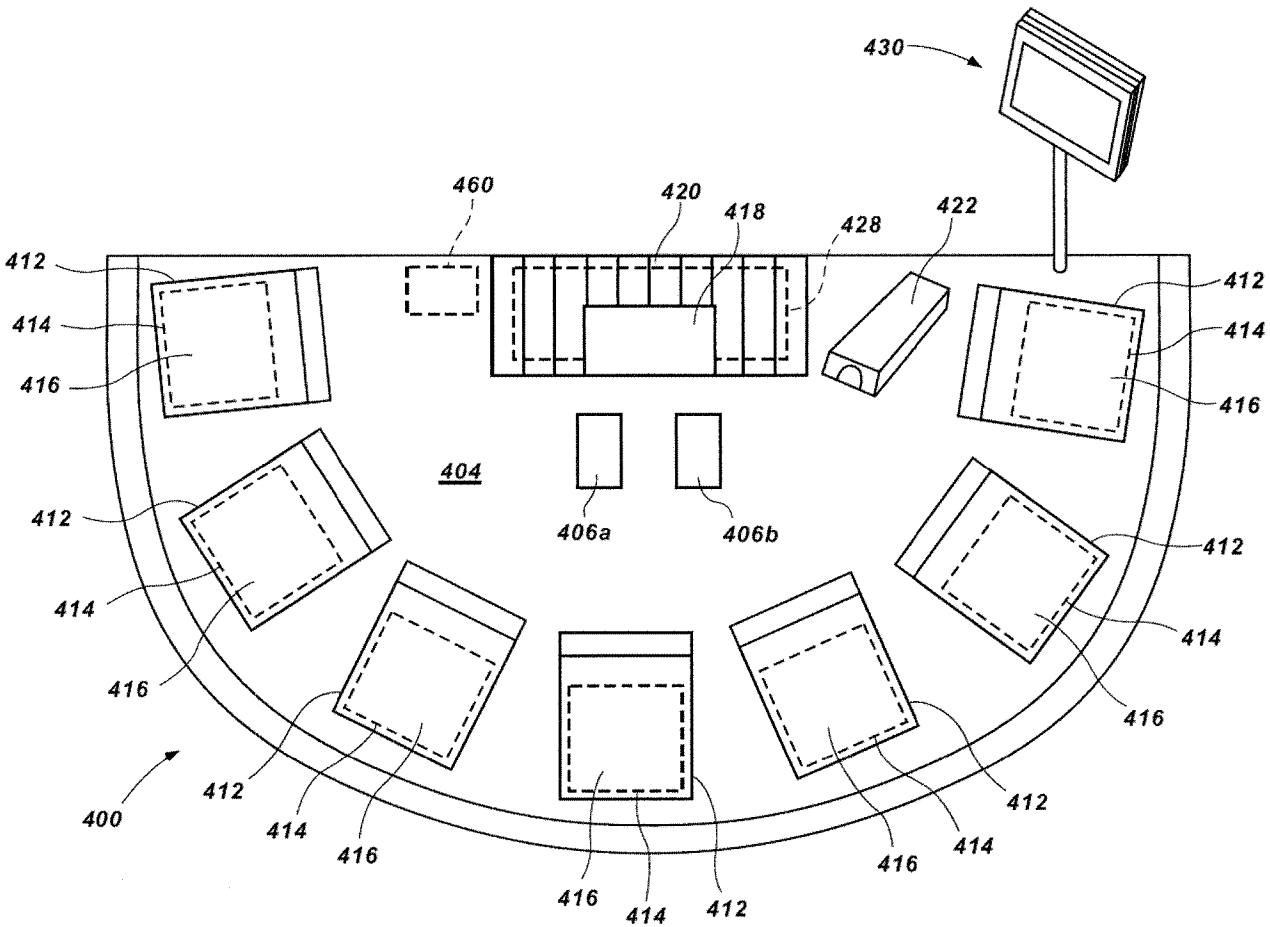
FIG. 6 is a top view of a table configured for implementation of embodiments of wagering games in accordance with this disclosure.

FIG. 6 is a top view of a suitable table 400 configured for implementing wagering games according to this disclosure. The table 400 may include a playing surface 404. The table 400 may include player stations 412. Each player station 412 may include a player interface 416, which may be used for electronically displaying game information (e.g., game instructions, input options, wager information, game outcomes, etc.) and accepting player elections. The player interface 416 may be a display screen in the form of a touchscreen, which may be at least substantially flush with the playing surface 404 in some embodiments. Each player interface 416 may be operated by its own local game processor 414 (shown in dashed lines), although, in some embodiments, a central table game processor 428 (shown in dashed lines) may be employed and may communicate directly with player interfaces 416. In some embodiments, a combination of individual local game processors 414 and the central table game processor 428 may be employed. Each of the processors 414 and 428 may be operably coupled to memory including one or more programs related to the rules of game play at the table 400.

A communication device 460 (shown in dashed lines) may be included and may be operably coupled to one or more of the local game processors 414, the central table game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers) and credit meters. For embodiments using physical cards 406*a* and 406*b*, the table 400 may further include a card-handling device 422, which may be configured to shuffle, read, and deliver physical cards for the dealer and players to use during game play or, alternatively, a card shoe configured to read and deliver cards that have already been randomized. For embodiments using virtual cards, the virtual cards may be displayed at the individual player interfaces 416. Common virtual cards may be displayed in a common card area.

The table 400 may further include a dealer interface 418, which, like the player interfaces 416, may include touchscreen controls for receiving dealer inputs and assisting the dealer in administering the wagering game. The table 400 may further include an upright display 430 configured to display images that depict game information such as paytables, hand counts, historical win/loss information by player, and a wide variety of other information considered useful to the players. The upright display 430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 7:
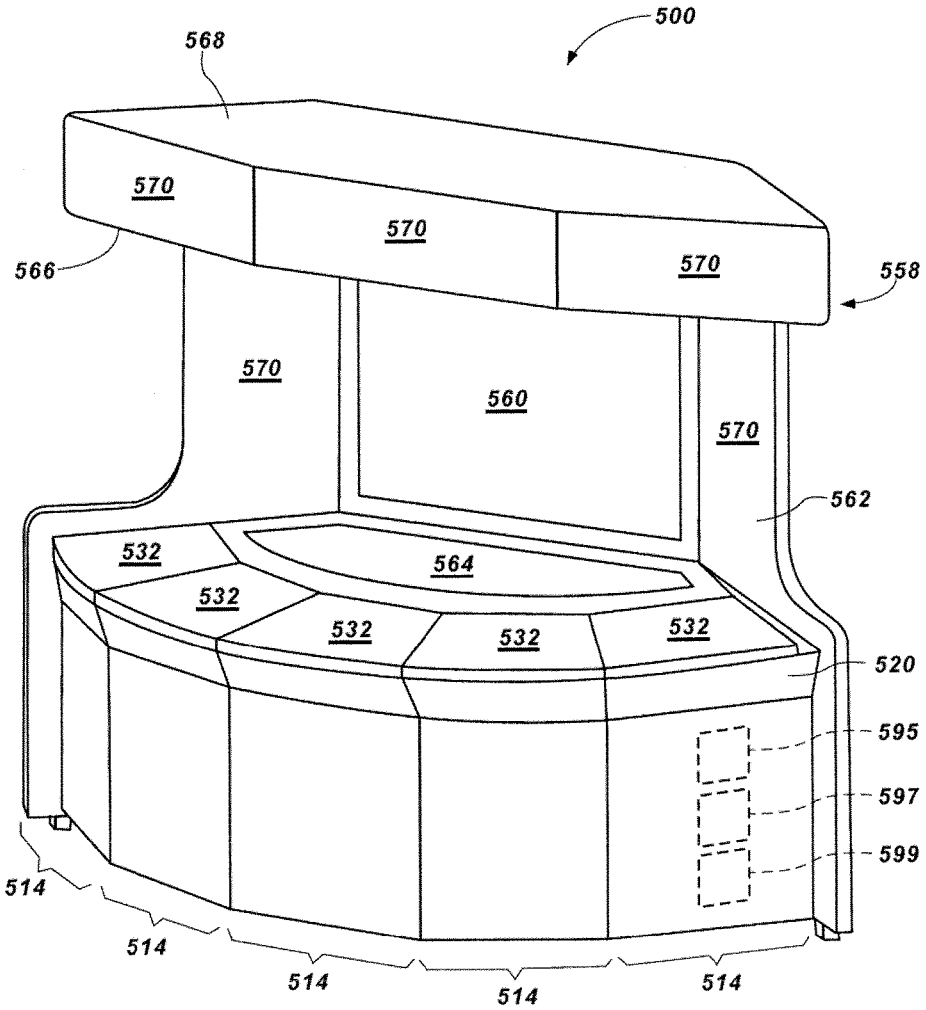
FIG. 7 is a perspective view of another embodiment of a table configured for implementation of embodiments of wagering games in accordance with this disclosure, wherein the implementation includes a virtual dealer.

FIG. 7 is a perspective view of another embodiment of a suitable table 500 configured for implementing wagering games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device. As noted above, although the game play may be accommodated without involving live personal, the game play may still include a dealer payout, payable to a dealer pool. The dealer payout may fund a dealer pool from which dealers dealing at a live table may receive dealer tips, for example.

A communication device 599 may be included and operably coupled to the control processor 597 such that information related to operation of the table 500, information related to the game play, or combinations thereof may be communicated between the table 500 and other devices, such as a central server, through a suitable communication medium, such as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 8:
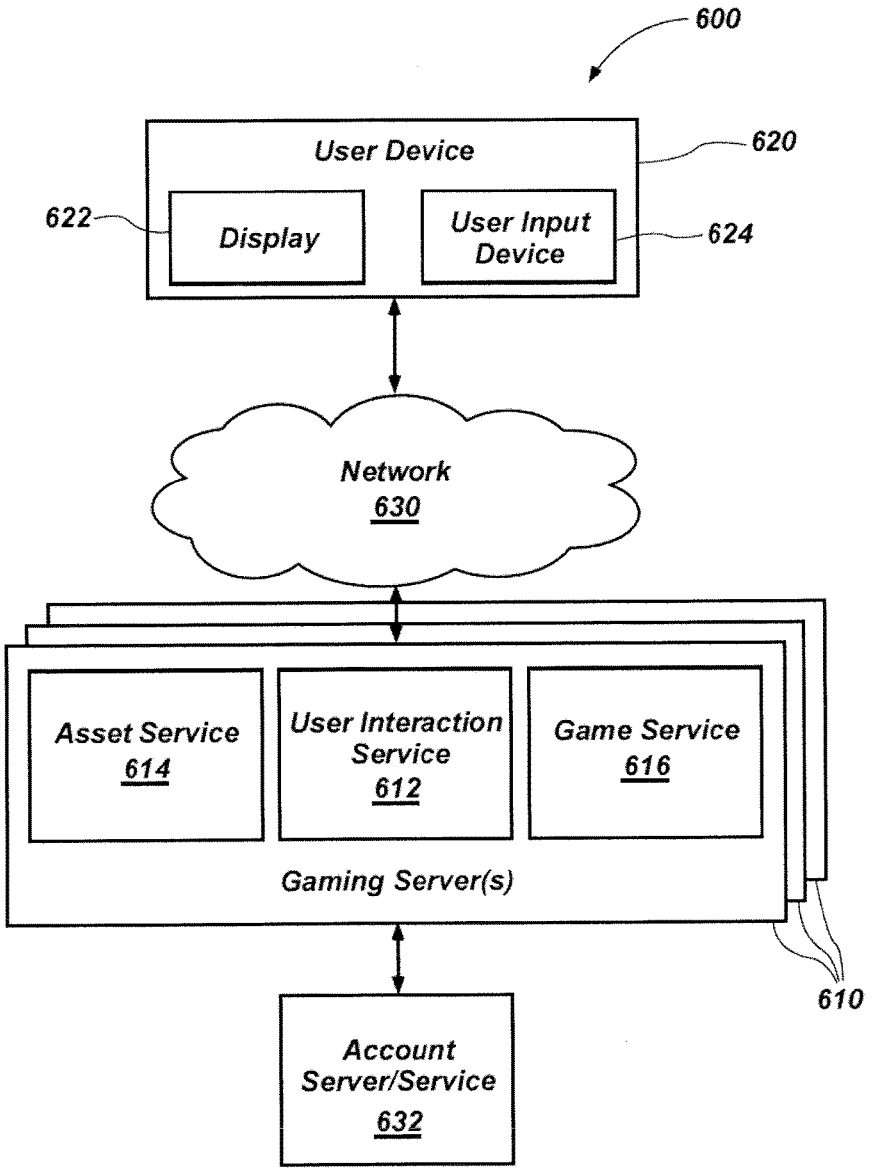
FIG. 8 is a schematic block diagram of a gaming system for implementing embodiments of wagering games in accordance with this disclosure.

In some embodiments, wagering games in accordance with this disclosure may be administered using a gaming system employing a client-server architecture (e.g., over the Internet, a local area network, etc.). FIG. 8 is a schematic block diagram of an illustrative gaming system 600 for implementing wagering games according to this disclosure. The gaming system 600 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In some embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically, the user device 620 is remote from the gaming servers 610 and the network is the worldwide web (i.e., the Internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 8, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated by one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include paytables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, nonlimiting example, the user device 620 operating the client may be an individual electronic gaming device 300 (see FIG. 5), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 9:
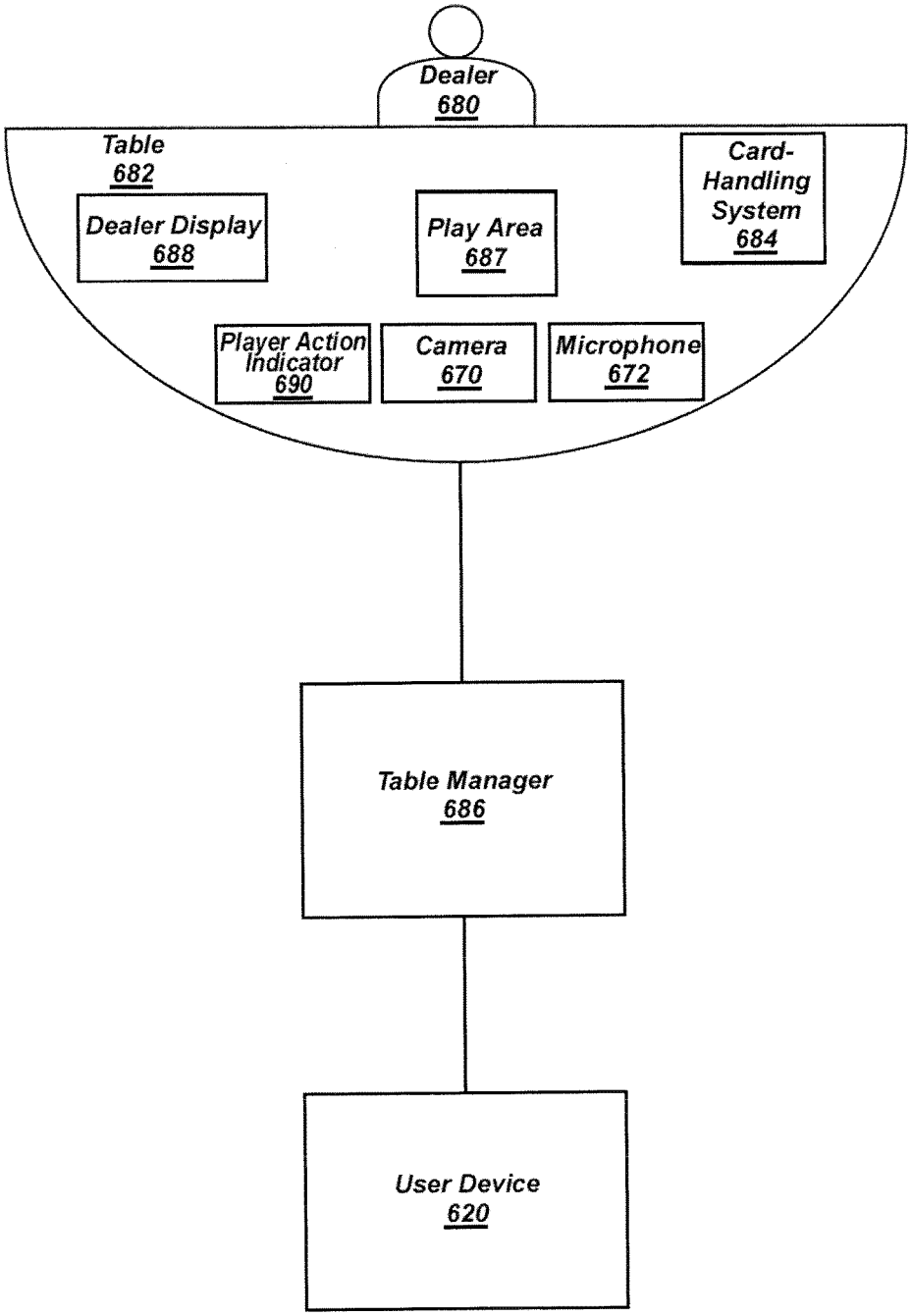
FIG. 9 is a schematic block diagram of a gaming system for implementing embodiments of wagering games including a live dealer feed.

FIG. 9 is a schematic block diagram of a table 682 for implementing wagering games including a live dealer feed. Features of the gaming system 600 (see FIG. 8) described above in connection with FIG. 8 may be utilized in connection with this embodiment, except as further described. Rather than cards being determined by computerized random processes, physical cards (e.g., from a standard, 52-card deck of playing cards) may be dealt by a live dealer 680 at a table 682 from a card-handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 (see FIG. 8) (e.g., acting as the gaming system 600 (see FIG. 8) itself or as an intermediate client interposed between and operationally connected to the user device 620 and the gaming system 600 (see FIG. 8)) to provide gaming at the table 682 to users of the gaming system 600 (see FIG. 8). Thus, the table manager 686 may communicate with the user device 620 through a network 630 (see FIG. 8), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600 (see FIG. 8), such as the one shown and described in connection with FIG. 8. In some embodiments, the gaming system 600 (see FIG. 8) may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600 (see FIG. 8).

The table 682 includes a camera 670 and optionally a microphone 672 to capture video and audio feeds relating to the table 682. The camera 670 may be trained on the dealer 680, play area 687, and card-handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The card-handling system 684 may be as shown and described previously in connection with FIG. 4. The play area 686 depicts player positions for playing the game, such as shown in FIGS. 2 and 3. As determined by the rules of the game, the player at the user device 620 may be presented options for responding to an event in the game using a client as described with reference to FIG. 8.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card-handling system 684 to identify cards dealt by the card-handling system 684. For example, the card-handling system 684 may include a card reader to determine card information from the cards. The card information may include the rank and suit of each dealt card and hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example.

The live video feed permits the dealer 680 to show cards dealt by the card-handling system 684 and play the game as though the player were at a live casino. In addition, the dealer 680 can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 10:
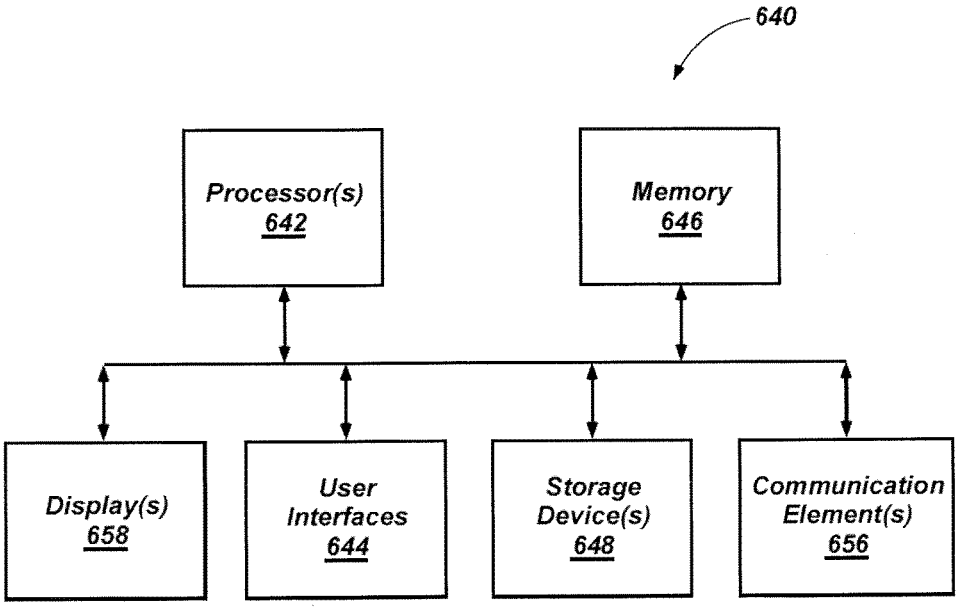
FIG. 10 is a block diagram of a computer for acting as a gaming system for implementing embodiments of wagering games in accordance with this disclosure.

FIG. 10 is a simplified block diagram showing elements of computing devices that may be used in systems and apparatuses of this disclosure. A computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light-emitting diode displays, liquid crystal displays, cathode ray tubes, and the like. In addition, the display 658 may be configured with a touch-screen feature for accepting user input as a user interface element 644.

As nonlimiting examples, the user interface elements 644 may include elements such as displays, keyboards, push-buttons, mice, joysticks, haptic devices, microphones, speakers, cameras, and touchscreens.

As nonlimiting examples, the communication elements 656 may be configured for communicating with other devices or communication networks. As nonlimiting examples, the communication elements 656 may include elements for communicating on wired and wireless communication media, such as, for example, serial ports, parallel ports, Ethernet connections, universal serial bus (USB) connections, IEEE 1394 ("firewire") connections, THUNDERBOLT™ connections, BLUETOOTH® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one nonlimiting example, the memory 646 may be divided into cache memory, graphics memory, and main memory. Each of these memories may communicate directly or indirectly with the one or more processors 642 on separate buses, partially combined buses, or a common bus.

As a specific, nonlimiting example, various methods and features of the present disclosure may be implemented in a mobile, remote, or mobile and remote environment over one or more of Internet, cellular communication (e.g., Broadband), near-field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted the features can be expressed as entertainment only gaming where players wager virtual credits having no value or risk no wager whatsoever such as playing a promotion game or feature.

Figure 11:
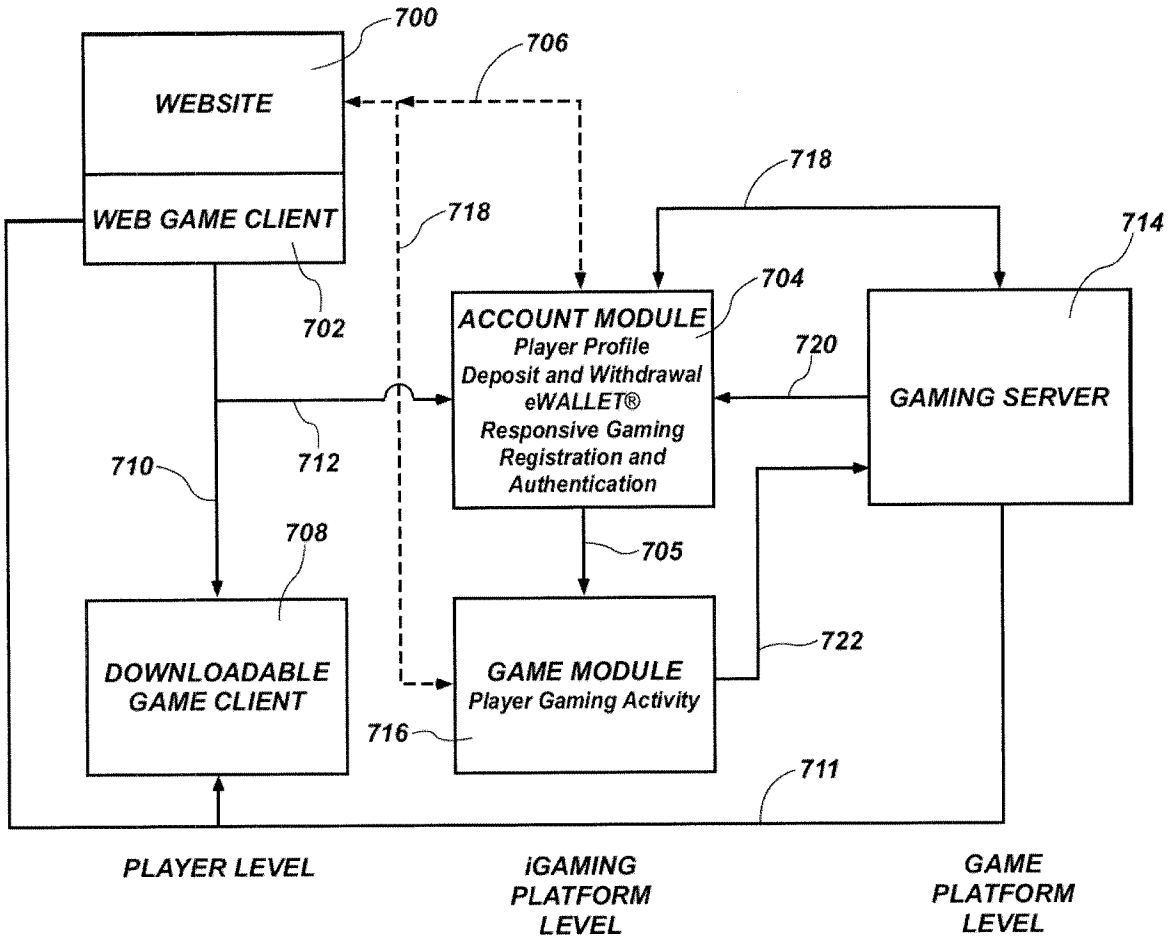
FIG. 11 illustrates an embodiment of data flows between various applications/services for supporting the game, feature or utility of the present invention for mobile/interactive gaming.

FIG. 11 illustrates an illustrative embodiment of information flows in an iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the gaming server 714 may process value-based wagers (e.g., money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The website 700 may access a player-centric, iGaming-platform-level account module 704 at information flow 706 for the player to establish and confirm credentials for play and, where permitted, access an account (e.g., an eWALLET®) for wagering. The account module 704 may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module 716 may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718, player account and log-in information may be provided to the gaming server 714 from the account module 704 to enable gaming. Information flow 720 provides wager/credit information between the account module 704 and gaming server 714 for the play of the game and may display credits and eWALLET® availability. Information flow 722 may provide player tracking information for the gaming server 714 for tracking the player's play. The tracking of play may be used for purposes of providing loyalty rewards to a player, determining preferences, and the like.

All or portions of the features of FIG. 11 may be supported by servers and databases located remotely from a player's mobile device and may be hosted or sponsored by a regulated gaming entity for P2P gaming or, where P2P is not permitted, for entertainment only play.

In some embodiments, wagering games may be administered in an at least partially player-pooled format, with payouts on pooled wagers being paid from a pot to players and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, the game administrator may not obtain profits from chance-based events occurring in the wagering games that result in lost wagers. Instead, lost wagers may be redistributed back to the players. To profit from the wagering game, the game administrator may retain a commission, such as, for example, a player entrance fee or a rake taken on wagers, such that the amount obtained by the game administrator in exchange for hosting the wagering game is limited to the commission and is not based on the chance events occurring in the wagering game itself. The game administrator may also charge a rent or flat fee to participate. Specific, illustrative mechanisms for redistributing the lost wagers back to players are described in connection with FIGS. 12 and 13.

Figure 12:
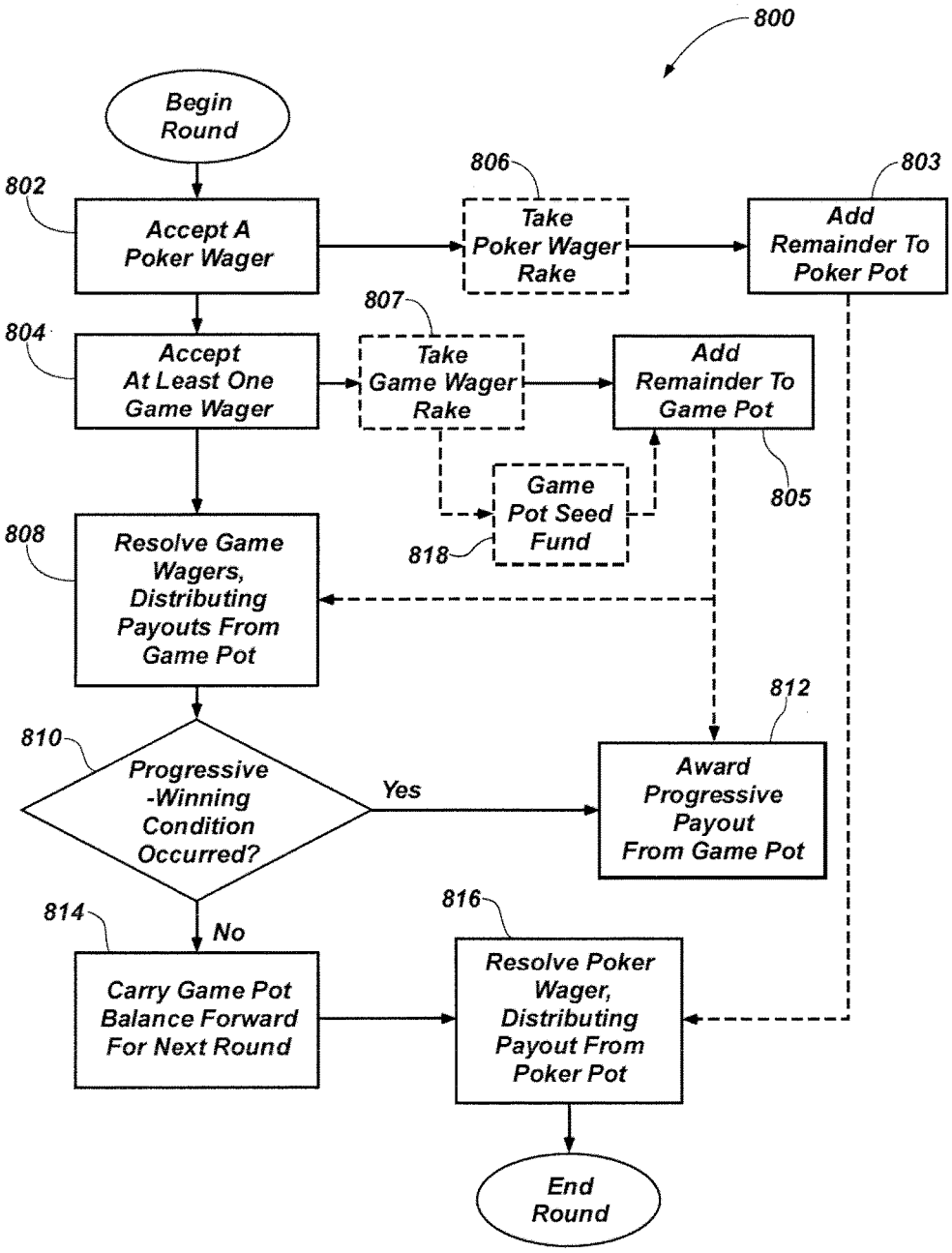
FIG. 12 is a flowchart diagram of a method of administering a wagering game, which may be at least partially player-pooled, according to a player-pooled progressive embodiment.

Referring to FIG. 12, a flowchart diagram of a method 800 of administering a wagering game is shown, which may be at least partially player-pooled, according to a player-pooled progressive embodiment. The method 800 includes accepting a first mandatory wager, referred to herein as a "poker wager," as indicated at 802. At least a portion of the poker wager is added to a poker pot, as indicated at operation 803. The poker wager may be later resolved by comparing player hands and awarding the poker pot, or at least a portion thereof, to the player holding a highest ranking poker hand in that round of play. For example, in a three-card game, a straight flush may have the highest ranking. A three-of-a-kind may have the next highest ranking, followed by a straight, a flush, and a pair. A pairs of aces may have a higher rank than pairs of kings, pairs of kings may outrank pairs of queens, etc., with a pair of twos being the lowest ranking pair. For hands that do not form a straight flush, a three-of-a-kind, a straight, a flush, or a pair, the hand with the highest high card (e.g., ranking from highest to lowest, A, K, Q, J, 10, 9, etc.) may win. As yet another example in a five-card game (e.g., one where each participating player's hand is based on a five-card hand from six cards made up of three player cards and three dealer cards), four-of-a-kind would outrank three-of-a-kind.

The poker pot may be a nonprogressive pot; more specifically, all or substantially all of the poker pot may be distributed at the conclusion of each round of the wagering game. In some embodiments, the poker wager may be a mandatory wager to qualify the player for play of the underlying wagering game. In other embodiments, the poker wager may be optional, and the wagering game may be administered to a player without receiving the poker wager and without qualifying the player for a potential payout from the poker pot.

At least one game wager may also be accepted, as indicated at 804. The game wagers may include, for example, base game wagers (e.g., ante wagers, blind wagers, play wagers, raises, and other wagers made on the underlying wagering game), side wagers, or both. More specifically, the game wagers may comprise, for example, the ante wager, the play wager, the bonus wager, and the optional side wager. At least a portion of each game wager is added to a game pot, as indicated at operation 805, which game pot may be a progressive pot.

In some embodiments, acceptance of the at least one game wager qualifies a player to be eligible to win an award in addition to the payouts available from the underlying game (i.e., the ante wager, the play wager, the bonus wager, the optional side wager), such as, for example, a progressive payout (e.g., a progressive jackpot awarded to one or more qualifying players). Therefore, in some such embodiments, a progressive wager may be received, in addition to the other game wagers received from the player, such as the ante wager, the play wager, the bonus wager, and the optional side wager. In other such embodiments, one of the game wagers may be converted to a progressive wager, such as, for example, the ante wager, the play wager, the bonus wager, and the optional side wager. In some embodiments, the progressive wager may be a mandatory wager to qualify the player for play of the underlying wagering game. In other embodiments, the progressive wager may be optional, and the wagering game may be administered to a player without receiving the progressive wager, in addition to any other game wagers, from the player and without qualifying the player to be eligible to win the progressive payout from the game pot. The dealer or the dealer pool may be eligible to receive the dealer payout when a participating player receives the bonus payout.

In some embodiments, the poker wager and the at least one game wager may be received as indistinct wagers, with a portion thereof being designated for the poker pot (a non-progressive pot) and another portion being designated for the game pot (a progressive pot).

In some embodiments, the game pot may be a pooled or linked pot. For example, the game pot may include one or more game wagers accepted from multiple concurrent wagering games. As another example, the game pot may include pooled progressive wagers from those wagering games currently being played and may include accumulated game wagers from past wagering games. As specific, non-limiting examples, the game pot may include all game wagers accepted from a group of electronic gaming tables or other local wagering game administration devices at a casino, from multiple groups of remote devices connected to network gaming architecture, or both. In other embodiments, the game pot may not be pooled, and awards for the game wager may be limited to the amounts wagered at a respective electronic gaming table, other local wagering game administration device, or group of remote devices.

The game administrator may take a "rake" (e.g., a commission for the house) on at least one wager, such as the poker wager, as indicated at operation 806, the at least one game wager, as indicated at operation 807, or both. In some embodiments, therefore, a rake may be taken on all wagers, or any wager. For example, the house may collect a portion of the poker wager at the time the poker wager is placed. Additionally or alternatively, the house may collect a portion of the game wagers at the time the game wagers are placed. In some embodiments, the house may collect the rake and, within the same game, at least one of the dealer and the dealer pool may receive the dealer payout when a participating player receives a bonus payout.

The rake may be, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, nonlimiting examples, the percentage of the wagers (i.e., either or both of the poker wager and the at least one game wager) collected for the rake may be between 3% and 8%, between 4% and 7%, or between 5% and 6%. In other embodiments, the portion of the wagers collected for the rake may be a variable percentage of the wagers or may be a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All profits for the house may be made from the rake (or rakes or other commission) in some player-banked embodiments. In such embodiments, wagered amounts in excess of the rake are distributed either in the form of, for example, a progressive payout (as in a "player-pooled progressive" embodiment (FIG. 12)), a dividend refund (as in a "dividend refund" embodiment (FIG. 13)), or some combination thereof. Thus, the profits for the house may be limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers (e.g., the ante wager, the play wager, the bonus wager, and the optional side wager), including losses resulting from optimal and suboptimal play.

The rake may be maintained in a rake account, and profits for the house may be deducted from the rake account. When and if taken from the poker wagers, the poker wager rake (operation 806) may be taken by, for example, electronically transferring funds from the poker wagers to a poker pot rake account (e.g., as instructed by a game service 616 (see FIG. 8) using casino account servers 632 (see FIG. 8)). Likewise, when and if taken from the game wagers, the game wager rake (operation 807) may be taken by, e.g., electronically transferring funds from the game pot wagers to a game pot rake account (e.g., as instructed by the game service 616 (see FIG. 8) using casino account servers 632 (see FIG. 8)).

In some embodiments, the poker wager may be accepted (operation 802) at the beginning of a round of administration of the wagering game. One or more of the game wagers may be accepted (operation 804) at the beginning of the round as well, e.g., the ante wager, the play wager, the bonus wager, and the optional side wager. In some embodiments, additional game wagers may be accepted (operation 804), possibly raked (operation 807), and added to the game pot (operation 805) in the intermediate segments of the round of play, e.g., ante wager, the play wager, the bonus wager, and any additional side wagers.

The underlying wagering game may be played as described above, including resolving the game wagers received during the round of play, as indicated at operation 808. For example, the underlying wagering game may be played at least substantially as described previously in connection with FIGS. 1 through 3. In some embodiments, where the underlying game includes optional side wagers, the side wagers may be played at least substantially as described previously in connection with FIGS. 1 through 3. Payouts to be distributed as a result of resolving the game wagers (e.g., the ante wager, the play wager, the bonus wager, the optional side wagers), are paid from the game pot.

It is contemplated that only a portion of the game pot may be distributed, at operation 806, in the form of payouts on the underlying game. At least in embodiments in which the game pot is configured as a progressive pot (e.g., if one of the game wagers is a progressive wager or one game outcome of a low frequency pays the amount of the pot), all or substantially all of the remaining portion of the game pot may be designated for a potential progressive payout. For example, administering the player-pooled progressive embodiment of the player-pooled wagering game may include determining whether a progressive-winning condition has occurred, as indicated at operation 810. A progressive-winning condition may be predefined as a predetermined winning hand combination being dealt, which may result in an award of, for example, a portion of the game pot, or a premium winning hand composition being dealt, which may result in an award of, for example, an entire amount of the game pot. If such a progressive-winning condition has occurred during the round of game administration, a progressive payout may be awarded to the winning-hand-holding player, with the progressive payout being paid from the game pot, as indicated at operation 812. As just one example, a game may pay a progressive payout for a participating player when a five-card hand formed from the six cards comprised of three cards from the dealer's hand and three cards from the player's hand is a royal flush. If no progressive-winning condition has occurred, a progressive payout may not be paid from the game pot, but, rather, the game pot balance may be carried forward for the next round of play and so on, as indicated at operation 814, until a progressive-winning condition occurs during a subsequent round. Thus, the game pot may not be awarded at the end of each round of play, but may grow during each successive round in which no player is dealt a predetermined winning hand combination or a premium winning hand composition. However, if the underlying game payouts distributed at operation 808, or if a progressive payout is awarded at operation 812, without draining the game pot, the game pot may decrement until the game pot contributions, at operation 805, rebuild the game pot.

A predetermined winning hand combination may be, for example, a five-card hand including a royal flush, a straight flush, a four-of-a-kind, a full house, a flush, a straight, a three-of-a-kind, two pair, or one pair, wherein the five-card hand is formed from three player cards and three cards in the dealer's hand. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may be, for example, a royal flush, a straight flush, or a four-of-a-kind. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, nonlimiting example, after identification of a player hand achieving a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may involve crediting a player account with funds from the game pot or may comprise distributing physical money or physical representations of money from the game pot to the player.

Before, between, or after resolving the game wagers (operation 808), determining whether a progressive-winning condition occurred (operation 810), awarding a progressive payout (operation 812), or any combination thereof, the poker wager may be resolved, and the poker pot may be awarded to at least one player, as indicated at operation 816. Each successive round of receiving wagers, dealing cards, and resolving wagers may constitute a round of play, and the poker pot may be awarded to at least one player before the end of each round of play. The player to whom the poker pot is awarded may hold a highest ranking hand of all hands dealt in a round on a table using conventional poker rankings, or a ranking system specific to the disclosed games when compared to the hands of other players at the virtual "table."

Awarding the poker pot or the portion of the poker pot may involve crediting a player account of each winning player or may comprise distributing physical money or physical representations of money to each winning player.

In some embodiments, an entire amount of the poker pot may be awarded to at least one player before the end of each round of play. In such embodiments, the poker pot may be a nonprogressive pot. Awarding the entire amount of a poker pot to at least one player at the end of each round of play redistributes lost poker wagers attributable to suboptimal play to other players, rather than to the house.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 818) at the beginning of play, after the game pot or a portion of the game pot has been awarded, or both. In some embodiments, a minimum account balance sufficient to cover expected losses is retained when distributing a progressive payout (operation 812) such that no seed money is required in the game pot. For example, the game pot may be seeded from the rake account of the house (operation 818), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed-odds payout is to be awarded to the player holding the predetermined winning hand combination, the amount seeded to the game pot between those rounds of play may be at least as great as the maximum fixed-odds payout awardable for any predetermined winning hand combination. The game pot may be seeded each time the game pot is awarded in its entirety or each time the amount in the game pot is lower than the maximum fixed-odds payout.

Figure 13:
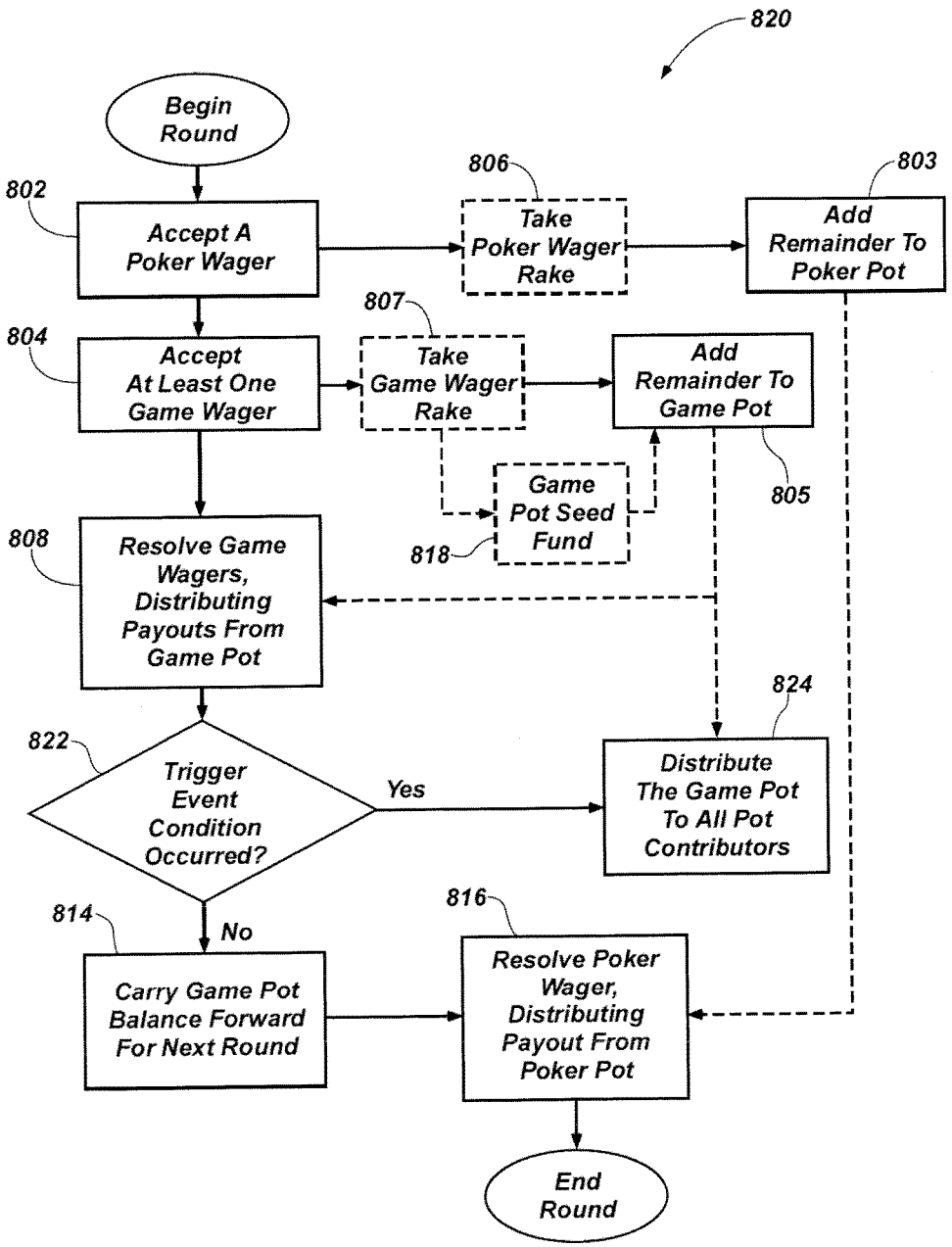
FIG. 13 is a flowchart diagram of a method of administering a wagering game, which may also be at least partially player-pooled, according to a dividend refund embodiment.

FIG. 13 is a flowchart diagram of a method 820 of administering a wagering game, which may be at least partially player-pooled, according to a dividend refund embodiment. The method 820 is largely the same as the method 800 of the player-pooled progressive (FIG. 12), with the exception that, rather than determining whether a progressive-winning condition has occurred (operation 810 (FIG. 12)), the method 820 includes determining whether a trigger event condition has occurred, as indicated at operation 822, and, if so, distributing the game pot to one or more past or present players of the wagering game, as indicated at operation 824 (rather than distributing the game pot as a progressive payout as at operation 812 (FIG. 12)). In such an embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

The game pot may be distributed among a plurality of players upon the occurrence of a predetermined event (referred to herein as a "trigger event"), as indicated at operation 822. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, amount-based, or other-based. Further details on pot distributions based on predetermined trigger events and conditions are disclosed in the U.S. Patent App. Pub. No. 2013/0296025, published Nov. 7, 2013, titled "DISTRIBUTING SUPPLEMENTAL POT IN WAGERING GAMES BASED ON PREDETERMINED EVENT," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in his or her player account.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given nonmonetary wagering elements, such as, for example, chips, points, or simulated currency, that are of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time access to another quantity of the wagering elements may be granted to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the ante wager, the play wager, the bonus wager, and the optional side wager) of no real-world monetary value, and payouts (e.g., the ante wager, the play wager, the bonus wager, and the optional side wager) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A method of administering a wagering game performed in the following order, comprising:

accepting an ante wager from a player to participate in a poker game by receiving at least one tangible, monetarily valuable gaming chip in a designated ante wager area on a play surface of a play table;

accepting an optional bonus wager from the player to participate in a bonus game by receiving at least another tangible, monetarily valuable gaming chip in a designated bonus wager area on the play surface of the play table;

delivering a set of player cards to the player in a player card receiving area on the play surface of the play table from a deck of physical cards comprising a set of at least one 52-card deck of standard playing cards utilizing a card-handling device configured to present randomized cards for delivery;

delivering a set of dealer cards to the dealer at a dealer card receiving area on the play surface of the play table from the card-handling device;

accepting a play wager from the player in response to offering the player a choice whether to place the play wager or fold;

paying the player a payout on the bonus wager when the player obtains a winning outcome according to rules of the bonus game;

paying a dealer payout to at least one of a dealer and a dealer pool when the player obtains one of a plurality of predetermined winning outcomes according to the rules of the bonus game, wherein the dealer does not make a wager to receive the dealer payout; and paying the player a payout on the ante wager when the player obtains a winning outcome according to rules of the poker game and taking each gaming chip associated with the ante wager when the player does not obtain a winning outcome according to the rules of the poker game.

2. The method of claim 1, wherein paying the player a payout on the bonus wager when the player obtains a winning outcome according to rules of the bonus game comprises:

forming a bonus hand comprising at least some cards from the set of player cards and at least some cards from the set of dealer cards; and paying the player the payout on the bonus wager when the bonus hand has a predetermined poker rank.

3. The method of claim 2, wherein:

delivering a set of player cards to the player comprises dealing three cards to the player; and delivering a set of dealer cards to the dealer comprises dealing three cards to the dealer.

4. The method of claim 3, wherein forming a bonus hand comprises forming a five-card bonus hand.

5. The method of claim 4, wherein paying the player the payout on the bonus wager when the bonus hand has a predetermined poker rank comprises paying an odds payout to the player on the bonus wager according to the following paytable:

| Five-Card Hand | Payout |
|---|---|
| Royal Flush | 500 to 1 |
| Straight Flush | 200 to 1 |
| Four-of-a-kind | 50 to 1 |
| Full House | 25 to 1 |
| Flush | 12 to 1 |
| Straight | 8 to 1 |
| Three-of-a-kind | 5 to 1. |

6. The method of claim 4, wherein paying a dealer payout to at least one of the dealer and a dealer pool comprises paying at least one of the dealer and the dealer pool according to the following paytable:

| Five-Card Hand | Dealer Payout |
|---|---|
| Royal Flush | $100 |
| Straight Flush | $25 |
| Four-of-a-kind | $10 |
| Full House | $5 |
| Flush | $3 |
| Straight | $1 |
| Three-of-a-kind | 0. |

7. The method of claim 1, wherein:

accepting an optional bonus wager from the player to participate in a bonus game comprises accepting an optional bonus wager from a plurality of players to participate in the bonus game; and paying a dealer payout to at least one of the dealer and a dealer pool when the player obtains one of a plurality of predetermined winning outcomes according to the rules of the bonus game comprises paying at least one of the dealer and the dealer pool for each player of the plurality of players who obtains a predetermined winning outcome according to the rules of the bonus game.

8. The method of claim 1, wherein paying a dealer payout to at least one of the dealer and a dealer pool when the player obtains one of a plurality of predetermined winning outcomes according to the rules of the bonus game comprises automatically paying at least one of the dealer and the dealer pool when the player obtains a predetermined winning outcome according to a predetermined paytable.

9. The method of claim 1, wherein paying a dealer payout to at least one of the dealer and a dealer pool when the player obtains a winning outcome according to the rules of the bonus game comprises paying at least one of the dealer and the dealer pool a fixed payout.

10. The method of claim 1, wherein accepting an ante wager from a player to participate in a poker game comprises accepting the ante wager from the player to participate in a game of three-card poker.

11. The method of claim 1, further comprising accepting a side wager from the player to participate in a side wager game and paying the player a payout on the side wager when the set of player cards comprises at least one of a straight flush, a three-of-a-kind, a straight, a flush, or a pair.

12. A method of administering a wagering game performed in an order specified below, comprising:

accepting an ante wager from a participating player to participate in a poker game according to a set of poker game rules by receiving at least one tangible, monetarily valuable gaming chip in a designated ante wager area on a play surface of a gaming table layout;

accepting a bonus wager from the participating player to participate in a bonus game according to a set of bonus game rules by receiving at least another tangible, monetarily valuable gaming chip in a designated bonus wager area on the play surface of the gaming table layout;

dealing a set of player cards to the participating player in a player card receiving area on the play surface of the gaming table layout from a deck of physical cards comprising at least one 52-card deck of standard playing cards utilizing a card-handling device configured to present randomized cards for delivery;

dealing a set of dealer cards to a dealer at a dealer card receiving area on the play surface of the gaming table from the card-handling device;

resolving the ante wager according to the set of poker game rules;

resolving the bonus wager according to the set of bonus game rules; and paying a dealer payout to at least one of the dealer and a dealer pool when the participating player achieves one of a plurality of winning outcomes on the bonus wager according to the set of bonus game rules.

13. The method of claim 12, wherein resolving the bonus wager comprises forming a bonus hand and paying the player a payout on the bonus wager when the bonus hand comprises a predetermined poker rank.

14. The method of claim 13, wherein forming the bonus hand comprises selecting at least some cards from the set of player cards and selecting at least some cards of the set of dealer cards to form the bonus hand.

15. The method of claim 14, wherein:

forming the bonus hand comprises forming a five-card bonus hand; and paying a dealer payout to at least one of the dealer and a dealer pool when the participating player achieves a winning outcome on the bonus wager comprises paying the dealer payout when the five-card bonus hand has a predetermined poker rank.

16. The method of claim 15, wherein paying a dealer payout to at least one of the dealer and a dealer pool when the participating player achieves a winning outcome on the bonus wager comprises resolving the bonus wager according to the following paytable:

| Five-Card Hand | Dealer Payout |
|---|---|
| Royal Flush | $100 |
| Straight Flush | $25 |
| Four-of-a-kind | $10 |

-continued

| Five-Card Hand | Dealer Payout |
|---|---|
| Full House | $5 |
| Flush | $2 |
| Straight | $1 |
| Three-of-a-kind | 0. |

17. The method of claim 12, wherein paying a dealer payout to at least one of the dealer and a dealer pool when the participating player achieves a winning outcome on the bonus wager comprises paying at least one of the dealer and the dealer pool when the participating player achieves the winning outcome on the bonus wager without requiring the dealer to place a wager.

18. The method of claim 12, wherein paying a dealer payout to at least one of the dealer and a dealer pool when the participating player achieves a winning outcome on the bonus wager comprises paying the dealer payout to the dealer pool.

19. The method of claim 18, further comprising distributing payouts from the dealer pool to a plurality of live dealers.

20. A method of administering a wagering game performed in the following order, comprising:

accepting at least one wager from a player to participate in a card game by receiving at least one tangible gaming chip from the player;

accepting a bonus wager from the payer to participate in a bonus game by receiving at least another tangible, gaming chip from the player;

dealing a set of player cards to the player in a player card receiving area on a play surface of the play table from a deck of physical cards comprising a set of at least one 52-card deck of standard playing cards;

paying the player a payout on the bonus wager when the player obtains a winning outcome according to rules of the bonus game by transferring at least one tangible gaming chip to the player; and paying a dealer payout to at least one of the dealer and a dealer pool when the player obtains at least one predetermined winning outcome according to the rules of the bonus game.

* * * * *